US006212356B1

(12) United States Patent
Ishikawa et al.

(10) Patent No.: US 6,212,356 B1
(45) Date of Patent: Apr. 3, 2001

(54) FIXING APPARATUS

(75) Inventors: Youichi Ishikawa; Takeshi Kato, both of Minato-ku (JP)

(73) Assignee: Nitto Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/446,510

(22) PCT Filed: Jun. 24, 1998

(86) PCT No.: PCT/JP98/02825

§ 371 Date: Apr. 25, 2000

§ 102(e) Date: Apr. 25, 2000

(87) PCT Pub. No.: WO99/00713

PCT Pub. Date: Jan. 7, 1999

(30) Foreign Application Priority Data

Jun. 27, 1997 (JP) ..... 9-186040
Jun. 1, 1998 (JP) ..... 10-165852

(51) Int. Cl.[7] ..... G03G 15/20
(52) U.S. Cl. ..... 399/329; 399/320
(58) Field of Search ..... 399/329, 330, 399/320, 335, 336; 219/216, 469, 470, 471

(56) References Cited

U.S. PATENT DOCUMENTS 5,666,623 * 9/1997 Yamada et al. ..... 399/320
5,671,473 * 9/1997 Yamada et al. ..... 399/320
5,713,069 * 1/1998 Kato ..... 399/330
5,752,148 * 5/1998 Yoneda et al. ..... 399/329
6,091,926 * 7/2000 Yamada ..... 399/329
6,118,955 * 9/2000 Yoneda et al. ..... 399/329 X

FOREIGN PATENT DOCUMENTS 64-90477 4/1989 (JP) .
1-144084 6/1989 (JP) .
4-136967 5/1992 (JP) .
5-127551 5/1993 (JP) .
5-134471 5/1993 (JP) .
8-262892 10/1996 (JP) .
8-339133 12/1996 (JP) .
10-63125 * 3/1998 (JP) .
10-133506 * 5/1998 (JP) .

* cited by examiner

*Primary Examiner*—Susan S. Y. Lee
(74) *Attorney, Agent, or Firm*—Armstrong, Westerman, Hattori, McLeland, & Naughton, LLP

(57) ABSTRACT

A fixing apparatus is capable of ensuring the increase of the feeding speed of the recording medium, by effectively accomplishing to preheat the recording medium. In order to accomplish the object, the fixing apparatus (10) have a fixing roller (22), and a pressing roller (24) being rollingly contacted the fixing roller (22) by a predetermined pressure, wherein an unfixed toner image which is carried on a sheet (S) is fixed thereon by passing the sheet (S), on which the toner image is carried, through a nip portion between the fixing roller (22) and the pressing roller (24) along one direction, and further have a heater (26) provided so as to be remote from said fixing roller (22), a heating roller (28) provided so as to be remote from the fixing roller (22), a fixing belt (32) endlessly trained around the heating roller (28) and fixing roller (22), for heating the sheet (S) passing through the nip portion upon receiving the heat from the heater (26), a supporting member (30) fixed on an upstream side of pressing roller (24) with respect to one direction, for supporting the undersurface of the sheet (S) prior to passing through the nip portion, and a heating member (34) for heating the supporting member (3) to preheat the sheet (S) prior to pass through the nip portion.

35 Claims, 20 Drawing Sheets

FIXING APPARATUS

FIELD OF TECHNOLOGY

The present invention relates to a fixing apparatus which is used for fusing and pressing an unfixed toner carried on a recording medium to fix the toner to the recording medium.

TECHNICAL BACKGROUND

Recently, a fixing apparatus for use in an electric image forming apparatus has been developed which is disclosed in Japanese Patent Laid-Open Publication HEI 9-73243, for example, not employing a conventional heating roller type fixing system. The conventional fixing process is provided with a heat accumulation step of accumulatively heating a thin heating medium on upstream side of a fixing stage with respect to a feeding direction of the heating medium which is fed along the fixing stage, a heat/press step of clamping the heating medium and a recording medium to contact with each other, being sandwiching an unfixed toner image on the recording medium therebetween in the fixing stage after the heat accumulating step to heat and fuse the unfixed toner image on the recording medium using the heat accumulated in the heating medium as well as to press it to fix the toner image onto the recording medium, a peeling step of peeling off the fixed recording medium from the heating medium after the heat/press step. The aim to constitute such a conventional fixing process is to enable to quickly start, to correspond to a high-speed type machine, to eliminate an offset phenomenon in a case of full-color image, to obtain the color image with good quality, to reduce the electric power consumption, and to respond to a toner image having a different glossiness. Especially, in the conventional fixing process, it is disclosed that a preheat step of preheating the recording medium on the upstream side of the fixing stage with respect to the feeding direction of the recording medium is further provided.

In the conventional fixing apparatus as described above, the heating medium is constructed so as not to discharge the heat energy being accumulating the heat energy therein prior to the fixing stage, and to heat the toner image on the recording medium using the heat energy accumulated in the heating medium at the heat/press step (fixing step). Accordingly, with respect to a speed of heat transfer which is defined from the heater housed in the heating roller through the fixing belt (heat transfer belt) to the recording medium at the heat/press step (fixing step), it was difficult to accelerate a transfer speed of the recording medium which passes through the fixing stage. Even though the recording medium has been preheated prior to the fixing stage, it was also difficult to accelerate the transfer speed of the recording medium. Thus, it was difficult to accelerate the transfer speed of the recording medium to increase the copying number per a unit time (i.e., per one minute) even though the conventional technical skill disclosed in the aforesaid Laid-Open Publication was applied. As a result, it causes to set a nip width at the fixing stage to be large, whereby it was in danger of occurring the other bad influence in the fixing apparatus.

On the other hand, a fixing apparatus for an electrophotographic machine disclosed in Patent Laid-Open Publication HEI 8-2865335 is known as a preceding patent application with the same applicant as the present patent application. In the preceding patent application, a fixing belt is trained around the fixing roller and the heating roller and is constructed to preheat the unfixed toner formed on the recording sheet prior to pass a nip portion defined between the fixing roller and the pressing roller, using the heat radiation from the fixing belt which is heated by the heat conduction from the heating roller. Since the temperature of the heating roller is so controlled as to maintain the temperature thereof to a constant value, it is possible to accomplish the preheat effect certainly.

However, the atmosphere temperature in a preheat space which is defined from a space between the fixing belt and a guide plate for guiding the sheet with the unfixed toner image thereon to the nip portion and being provided under the fixing belt varies widely due to the influence of the temperature of the guide plate. Furthermore, the sheet with the unfixed toner image thereon guided on the guide plate would be preheated by a contact with the guide plate. However, the effect of the preheat from the guide plate will depend on the temperature of the guide plate. Please note that the temperature of the guide plate is different between a case just after a warming up operation is finished and a case in a continuous feeding period, depending on feed modes, as shown in a Table 1. Also, the temperature of the guide plate is different between at least a case in which the image is of mono-color and a case in which the image is of full-color, depending on the thickness (t) of the guide plate, as shown in FIG. 16. Thus, the preheat effect by the guide plate is not maintained certainly, but conversely a problem due to the bad influence of the preheat by the guide plate has been pointed out. It should be noted that the numerals indicated in the table 1 are temperature (°C.) at each measuring point.

TABLE 1

| | | | | | idle rotating time after warming up | | | | | full-color mode feeding | mono-color mode feeding |
|---|---|---|---|---|---|---|---|---|---|---|---|
| | | object to be measured | initial time | just after warming up | 1 minute later | 3 minutes later | 5 minutes later | 7 minutes later | 10 minutes later | speed (5 cpm) | speed (20 cpm) |
| Guide plate (Thickness 1.6 mm) | at first in morning | heating roller | 28 | 155 | 158 | 161 | 161 | 162 | 162 | | |
| | | fixing roller | 28 | 155 | 160 | 163 | 165 | 166 | 167 | | |
| | | pressing rollerg | 28 | 130 | 140 | 149 | 153 | 155 | 157 | | |
| | | guide plate | 28 | 44 | 58 | 72 | 77 | 80 | 83 | | |
| | stand-by | heating roller | 173 | 159 | 160 | 161 | 162 | 162 | 162 | 163 | 156 |
| | | fixing roller | 70 | 155 | 160 | 163 | 166 | 167 | 168 | 159 | 154 |
| | | pressing roller | 53 | 126 | 141 | 150 | 154 | 156 | 158 | 151 | 102~116 |
| | | guide plate | 51 | 56 | 66 | 78 | 82 | 84 | 85 | 64 | 49 |

TABLE 1-continued

| | | object to be measured | initial time | just after warming up | idle rotating time after warming up: 1 minute later | 3 minutes later | 5 minutes later | 7 minutes later | 10 minutes later | full-color mode feeding speed (5 cpm) | mono-color mode feeding speed (20 cpm) |
|---|---|---|---|---|---|---|---|---|---|---|---|
| Guide plate (Thickness 0.5 mm) | at first in morning | heating roller | 26 | 156 | 159 | 159 | 159 | 159 | 161 | 156 | 155 |
| | | fixing roller | 26 | 148 | 155 | 158 | 159 | 161 | 161 | 154 | 147 |
| | | pressing roller | 26 | 128 | 137 | 146 | 150 | 152 | 153 | 144 | 102 |
| | | guide plate | 26 | 74 | 100 | 109 | 110 | 112 | 113 | 79 | 45 |
| | stand-by | heating roller | 168 | 160 | 160 | 159 | 160 | 160 | 160 | 155 | 155 |
| | | fixing roller | 62 | 149 | 157 | 161 | 163 | 163 | 163 | 153 | 149 |
| | | pressing roller | 47 | 139 | 141 | 150 | 154 | 156 | 157 | 144 | 118 |
| | | guide plate | 58 | 80 | 112 | 114 | 115 | 115 | 116 | 78 | 48 |
| Guide plate (Thickness 0.2 mm) | at first in morning | heating roller | 32 | 157 | 159 | 161 | 162 | 162 | 163 | | 157 |
| | | fixing roller | 32 | 156 | 161 | 164 | 166 | 167 | 167 | | 154 |
| | | pressing roller | 32 | 129 | 140 | 149 | 154 | 156 | 157 | | 96~109 |
| | | guide plate | 32 | 98 | 131 | 138 | 140 | 141 | 142 | | 48~52 |
| | stand-by | heating roller | 171 | 160 | 161 | 162 | 162 | 163 | 163 | 163 | 160 |
| | | fixing roller | 73 | 156 | 162 | 165 | 167 | 168 | 168 | 166 | 156 |
| | | pressing roller | 59 | 127 | 143 | 151 | 154 | 156 | 157 | 152 | 120 |
| | | guide plate | 85 | 102 | 131 | 140 | 141 | 142 | 142 | 104 | 48~54 |

On the other hand, where fixing apparatuses each of which has temperature characteristics of the heating roller, the fixing roller and the pressing roller as shown in FIGS. 4 through 6, in a case that the sheet feeding speed is changed among 40 mm/sec, 80 mm/sec and 120 mm/sec, are utilized, a glossiness of the fixed image on the sheet after the nip portion is totally different among a case just after a warm up operation in the morning (that is, from a cold condition), a case just after a warm up operation from a stand-by mode (that is, from a condition in which the temperature of the fixing roller 22 is set below 60 (°C.)), and a case of a stable feeding mode (that is, just after the fixing apparatus has been actuated for 6 minutes), as shown in FIGS. 17 through 19, respectively. In other words, there is problems in which the glossiness of the fixed toner image is not stable, the quality of the fixed toner image could not be maintained to be good, when the feeding speed of the sheet is changed.

When the temperature of the heating roller is maintained in a constant value so that a predetermined glossiness would be given just after the warm up operation (that is, in a case where the temperature of the guide plate is set to be low) is finished, the excessive heat will be given to the unfixed toner and the recording medium at the stable feeding mode (that is, the temperature of the guide plate is set to be high). Accordingly, the fixing apparatus has not a fixable area in reserve with respect to the high-temperature offset. As a result, it is necessary to apply an oil onto the outer peripheral surface of the fixing belt. Therefore, it has been desired to obviate this drawback.

Accordingly, it is a primary object of the present invention to provide a fixing apparatus which is capable of ensuring the increase of the feeding speed of the recording medium, by effectively accomplishing to preheat the recording medium.

It is another object of the present invention to provide a fixing apparatus which is capable of enhancing the preheat effect by preheating uniformly the recording medium.

It is different object of the present invention to provide a fixing apparatus which is capable of maintaining the good quality of the toner image even though the feeding speed of the recording medium is increased.

DISCLOSURE OF THE INVENTION

In order to solve the aforementioned problems and accomplish the above object, an inventive fixing apparatus comprises a fixing roller, and a pressing roller being rollingly contacted the fixing roller by a predetermined pressure, wherein an unfixed toner image which is carried on a sheet is fixed thereon by passing the sheet, on which the toner image is carried, through a nip portion between the fixing roller and the pressing roller along one direction, and further comprises a first heat generating means provided so as to be remote from said fixing roller, a heating roller provided so as to be remote from said fixing roller, a fixing belt endlessly trained around said heating roller and said fixing roller, for heating said sheet passing through said nip portion upon receiving the heat from said first heat generating means, a supporting member fixed on an upstream side of said pressing roller with respect to said one direction, for supporting the undersurface of said sheet prior to passing through said nip portion, and second heat generating means for heating said supporting member to preheat said sheet prior to pass through said nip portion.

In the inventive fixing apparatus, said supporting member includes one end neighboring said nip portion and the other end so as to be remote from said nip portion, and said the other end of the supporting member is set to be lower than said one end thereof.

In the inventive fixing apparatus, said supporting member is formed so as to be substantially flat.

In the inventive fixing apparatus, said supporting member is electrically grounded.

In the inventive fixing apparatus, said first heat generating means is housed in said heating roller.

In the inventive fixing apparatus, said first heat generating means includes a halogen lamp.

In the inventive fixing apparatus, said first heat generating means include a plate-like heat generating member attached to an inner peripheral surface of said heating roller.

In the inventive fixing, said first heat generating means is arranged so as to be out of said heating roller and opposing said fixing belt.

In the inventive fixing apparatus, said first heat generating means includes a plate-like heat generating member attached to an outer peripheral surface of said heating roller.

In the inventive fixing apparatus, said first heat generating means includes an induction heating means for heating said fixing belt by induction heating.

In the inventive fixing apparatus, said induction heating means is provided between said fixing roller and said heating roller, and heating that portion of said fixing belt which is positioned upstream side of said nip portion with respect to said running direction of said fixing belt.

In the inventive fixing apparatus, said fixing belt includes an endless belt and a separating layer coated on an outer circumferential surface of the endless belt base.

In the inventive fixing apparatus, said endless belt base is made of metal belt.

In the inventive fixing apparatus, said endless belt base is made of electro-formed nickel.

In the inventive fixing apparatus, said first heat generating means includes a halogen lamp opposing said fixing belt.

In the inventive fixing apparatus, said second heat generating means is constructed so as to heat said supporting member substantially over the surface thereof.

In the inventive fixing apparatus, said second heat generating means is housed in said supporting member.

In the inventive fixing apparatus, said second heat generating means is arranged so as to closely contact with the surface of said supporting member.

In the inventive fixing apparatus, said second heat generating means is attached to the under surface of said supporting member.

In the inventive fixing apparatus, said second heat generating means is attached to the upper surface of said supporting member.

In the inventive fixing apparatus, said second heat generating means is coated by a separating layer on its upper surface.

In the inventive fixing apparatus, said separating layer has an electro-conductivity.

In the inventive fixing apparatus, said second heat generating means is arranged below and remote from said supporting member.

In the inventive fixing apparatus, said second heat generating means is formed of a material which is capable of maintaining a predetermined shape, and said supporting member is constructed by said second heat generating means.

In the inventive fixing apparatus, said second heat generating means is coated by a separating layer on its upper surface.

In the inventive fixing apparatus, said separating layer has an electro-conductivity.

In the inventive fixing apparatus, said heating roller is arranged in a preheat effecting area in which the heat radiated from said fixing belt can preheat said sheet prior to pass through said nip portion.

In the inventive fixing apparatus, said heating roller is arranged out of a preheat effecting area in which the heat radiated from said fixing belt can preheat said sheet prior to pass through said nip portion.

In the inventive fixing apparatus, said fixing belt includes an endless belt and a separating layer coated on an outer circumferential surface of the endless belt base.

In the inventive fixing apparatus, said endless belt base is made of metal belt.

In the inventive fixing apparatus, said endless belt base is made of electro-formed nickel.

In the inventive fixing apparatus, said endless belt base is made of synthetic resin.

In the inventive fixing apparatus, said synthetic resin has an electro-conductivity.

In the inventive fixing apparatus, said endless belt base is made of polyimide.

In the inventive fixing apparatus, said polyimide has an electro-conductivity.

BEST MODE FOR CARRYING OUT THE INVENTION

Hereinafter, a construction of one embodiment of a fixing apparatus according to the present invention will be described in detail with reference to the accompanying drawings.

{General description of fixing apparatus 10}

Figure 1:
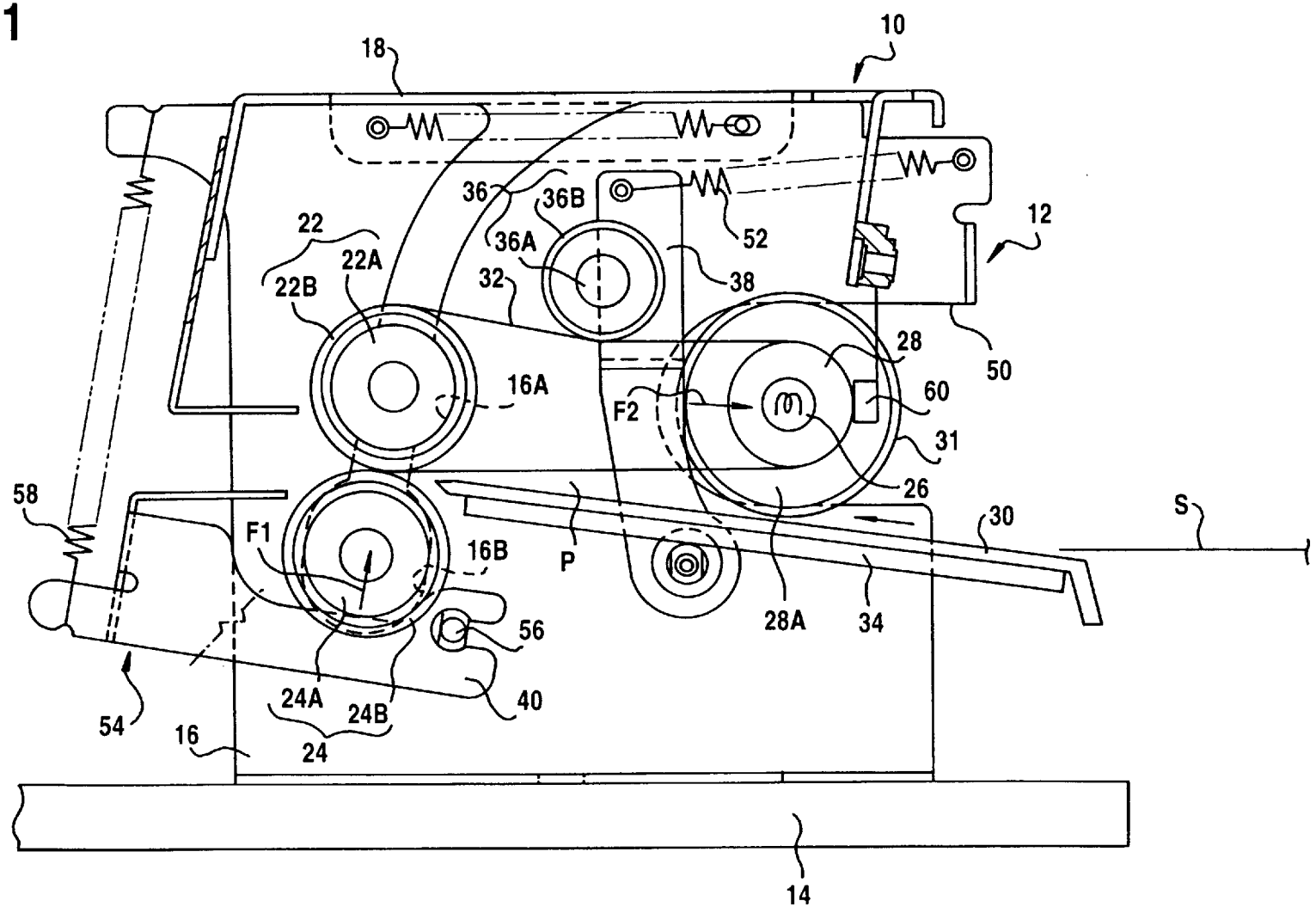
FIG. 1 is a front sectional view schematically showing a total construction of the fixing apparatus according to one embodiment of the present invention.

At first, as shown in FIG. 1, a fixing apparatus according to one embodiment of the present invention has a housing 12, as a housing structure, to be fixed to a frame of an electronic image forming apparatus such as an electronic copying machine (not shown). The housing 12 is provided with a base plate 14 to be fixed directly to the frame, a pair of vertical mounting stays 16 directly erected from respective side edges of the base plate 14, and an ceiling plate 18 connecting between the upper portions of the mounting stays 16.

It should be noted that the left direction indicated by an arrow in the drawing is defined as a feeding direction in which an unfixed sheet S on which an unfixed toner image is carried is fed. That is to say, the aforementioned mounting stays 16 are positioned so as to stand on right and left sides of the unfixed sheet S which is to be fed in the feeding direction and each of the mounting stays 16 extends in the feeding direction.

The fixing apparatus 10 also has a roller assembly including a fixing roller 22 rotatably supported on the mounting stays 16 for being rotatable about its own central axis, a pressing roller 24 positioned below the fixing roller 22 in rolling contact therewith, rotatably supported on the mounting stays 16 for rotation about its own central axis and movably supported to the mounting stays 16 in a vertical direction, and a heating roller 28 arranged on the upstream side of the fixing roller 22 with respect to the feeding direction of the unfixed sheet S, being movably supported to the mounting stays 16 in the feeding direction and having a heating source 26 such as a halogen lamp therein.

Furthermore, the fixing apparatus 10 is provided with a supporting member 30 which is fixed on the upstream side of the pressing roller 24 with respect to the feeding direction, for supporting the under surface of the unfixed sheet S (that is, a surface on which the unfixed toner image is not formed) and guiding the unfixed sheet S to a rolling contact region (nipping region) defined between the fixing roller 22 and the pressing roller 24, and an endless fixing belt 32 which is trained around the fixing roller 22 and the heating roller 28. The gap between the supporting member 30 and the fixing belt 32 serves as a preheating passage P for preheating the unfixed sheet S from above and below.

The fixing apparatus 10 is also provided with an oil applying roller 36 for applying silicone oil to an outer circumferential surface of the fixing belt 32 and cleaning the outer surface of the fixing belt 32, a tension lever 38 for urging the heating roller 28 so as to separate from the fixing roller 22, thereby applying a predetermined tension to the fixing belt 32 in cooperation with the oil applying roller 36, and a pressure lever 40 for urging the pressing roller 24 so as to approach it to the fixing roller 22, thereby pressing the pressing roller 24 to the fixing roller 22 through the fixing belt 32.

In the fixing apparatus 10 with such a construction, the unfixed sheet S which are transferred on the supporting plate 30 is further transferred to the rolling contact region in such a manner that the under surface on which the unfixed toner image is not formed is supported and guided by the supporting plate 30. Since the unfixed sheet S is passing through the rolling contact region with a high pressure, the unfixed toner on the sheet S is fused and pressed onto the sheet S to be fixed thereon.

{Description of fixing roller 22}

The fixing roller 22 includes a core 22A rotatably supported in circular first supporting holes 16A formed on the mounting stays 16 by bearings and a roller body 22B which is fitted coaxially over the core 22A and around which the fixing belt 32 is trained. The fixing roller 22 has an outside diameter of 20 mm in this embodiment. The core 22A is formed by a shaft of iron having a diameter of 12 mm, and the roller body 22B is made of a heat-resistant resilient material of silicone rubber (specifically, silicone rubber sponge having ASKER C hardness of 30 degrees) having a wall thickness of 4 mm.

It should be noted that a first driven gear (not shown) is fixed to the one end of the core 22A being coaxial thereto. A driving gear of a driving mechanism (not shown) is meshed with the first driven gear. A driving force from the driving mechanism is transmitted to the first driven gear through the driving gear to rotate the fixing roller 22.

{Description of pressing roller 24}

The pressing roller 24 includes a core 24A rotatably supported in elongated and arcuate second supporting holes 16B, which is formed on the mounting stays 16 so as to extend vertically, by bearings and movable in the extending direction thereof, and a roller body 24B fitted coaxially over the core 24A. The pressing roller 24 has an outside diameter of 20 mm in this embodiment. The core 24A comprises a shaft of iron having a diameter of 14 mm, and the roller body 24B is made of a heat-resistant resilient material of silicone rubber (specifically, the roller body 24B is made of silicone rubber sponge having a JIS Model A hardness of 40 degrees, which is harder than the fixing roller 22) having a wall thickness of 3 mm.

It should be noted that a second driven gear (not shown) is coaxially fixed to the one end of the core 24A. The first driven gear is meshed with the second driven gear. The driving force is transmitted from the first driven gear to the second driven gear to rotate the pressing roller 24 in a direction opposite to the fixing roller 22 with the same rotating speed.

Here, in the fixing apparatus 10, the transferring speed of the unfixed sheet S is set to be within a range from 10 mm/sec to 400 mm/sec, and the gap of the preheating passage P is set to be within a range from 0.5 mm to 10 mm, and various values are settled so as to satisfy condition wherein a preheating time for passing through a distance between the centers of fixing roller 22 and heating roller 28 is to be set within a range from 0.1 sec to 4 sec.

{Description of heating roller 28}

Figure 2:
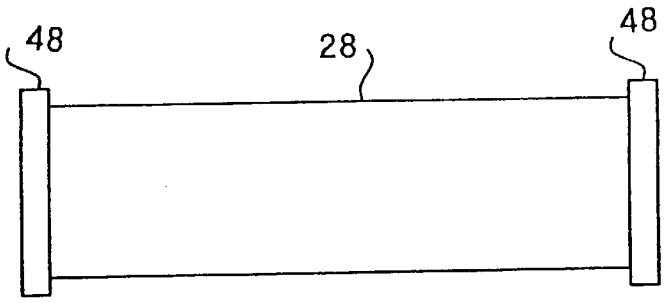
FIG. 2 is a side view of the heating roller which is used in the fixing apparatus shown in FIG. 1.

In this embodiment, as the heat source 26 in the heating roller 28, there is provided a 600W halogen lamp which is designed to emit light at an intensity that is 50% greater in opposite end regions than in a central region thereof. The heating roller 28 includes a core in the form of an aluminum pipe having a diameter of 20 mm and a wall thickness of 1.75 mm. The outer circumferential surface of the core is treated by a hard alumite. As shown in FIG. 2, a circular collar 48 made of heat-resistant polyetheretherketone (PEEK) and having a diameter of 24 mm is press-fitted over each of opposite supporting shaft portions of the heating roller for preventing the fixing belt 32 from being tortured or displaced out of position on the heating roller 28.

{Description of supporting member 30}

The fixing apparatus 10 is provided with the supporting plate 30 which serves as a guide plate for guiding the unfixed sheet S transferred by the transferring mechanism (not shown) to the rolling contacting region between the fixing roller 22 and the pressing roller 24. The supporting member 30 is positioned on the left side of the pressing roller 24, that is, on the upstream side of the pressing roller 24 with respect to the feeding direction of the unfixed sheet S, being fixed to the mounting stays 16.

Figure 3A:
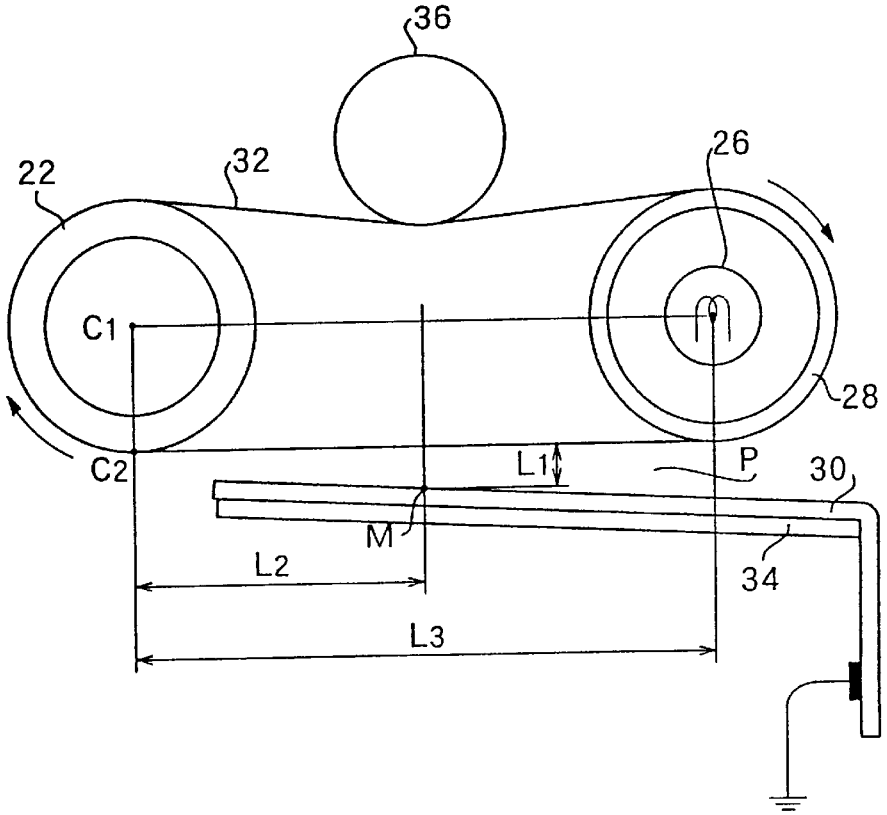
FIG. 3A is a front view showing a positional relationship of the supporting member which is used in the fixing apparatus shown in FIG. 1.

As shown in FIG. 3A, The supporting member 30 is settled in such a manner that a gap L1 between the upper surface the supporting member 30 and the lower run of the fixing belt 32 is set to 3 mm at a central position M which is defined by a crossing point of the upper surface of the supporting member 30 and the vertical line passing through an intermediate point between the heating roller 28 and fixing roller 22. Note that, in the embodiment, the distance L3 between the heating roller 28 and fixing roller 22 is set to 47 mm and a distance L2 between the central position M and a vertical line passing through the center of the fixing roller 22 is set to 23.5 mm.

Figure 3B:
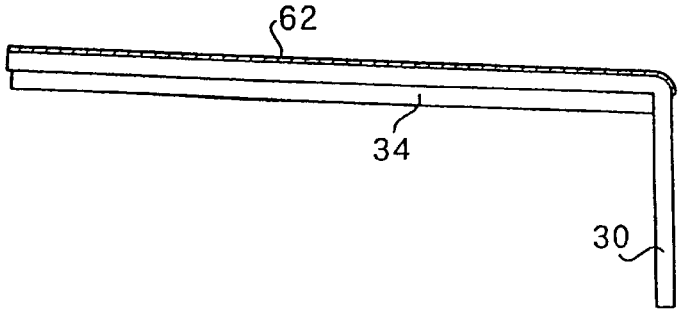
FIG. 3B is a front view of the supporting member shown in FIG. 3A.

As shown in FIG. 3B, the supporting member 30 is provided with a separating layer 62 formed of a fluoroplastics such as a PTFE (Polytetrafluoroethylene) etc., thereon. Although the supporting member 30, as shown in FIGS. 1 and 3A, is grounded in order to disturb the unfixed toner image, this is not limited to such a construction but it will be possible to use an electrically erasing brush, a varistor element, and a diode etc., instead of the grounding.

On the other hand, as shown in FIG. 1, it is settled that the lower run of the fixing belt 32 trained around the fixing roller 22 and heating roller 32 travels towards substantially in the horizontal direction, that is, to the left in the drawing. A distance between the supporting member 30 and the fixing belt 32 is set to be within a range of about 5 mm to 20 mm at a position just below the heating roller 28. That is to say, the supporting plate 30 is set to be slant to the horizontal lower run of the fixing belt 32 such that it extends to the nip region in a slanted manner. In other words, the supporting member 30 is formed of a substantially planer shape, with its one end (that is, an end on the side of nipping region) bing lower than the nipping region, and higher than its the other end (that is, an end opposite to the nipping region).

It should be noted that the lower run of the fixing belt 32 and the supporting member 30 define a so-called wedge shaped transferring space having the nip position as an apex. Accordingly, the unfixed sheet S is certainly transferred to the nip position between the fixing belt 32 and the pressing roller 24 upon the conveyance on the guide plate 34. In the nipping region, the unfixed sheet S which has been already preheated by a heat radiation from the fixing belt 32 is pressed by a predetermined pressure Fl and heated by the heat of the fixing belt 32, whereby the unfixed toner on the unfixed sheet S it heatedly fixed thereon.

On the other hand, a plate-like heater 34 (so-called panel heater) for heating the supporting member 30 totally is arranged on the under surface of the supporting member as a second heat generating means. More specifically, in the present embodiment, SAMICON HEATER (a trade name; 230:100W, manufactured by SAKAGUCHI ELECTRIC HEATING Co.) with a size of 50×200 mm is used as the plate-like heater 34. The plate-like heater 34 is closely fitted on the under surface of the supporting member 30.

Since the unfixed sheet S is preheated from below by the supporting member 30 which is directly heated by the plate-like heater 34, it would be possible to increase the feeding speed of the unfixed sheet S in cooperation with the preheat by the heat radiation from the fixing belt 32. This effect will be described in detail more with reference to results of experiments.

{Description of fixing belt 32}

The fixing belt 32 preferably has a heat capacity of 0.002 cal/° C.–0.025 cal/° C. per $cm^2$ so as to be able to preheat the unfixed toner on the unfixed sheet S to a fixing temperature through heat radiation for thereby fixing the toner. In this embodiment, the fixing belt 32 includes an endless belt base made of electro-formed nickel having a thickness of 40 μm and an inner diameter of 50 mm and a heat-resistant resilient separating layer of silicone rubber that is coated to a thickness of 150 μm on an outer circumferential surface of the endless belt base.

{Description of oil applying roller 36}

The fixing apparatus 10 is provided with an oil applying roller 36 which serves to apply a small amount of silicone oil to the outer circumferential surface of the fixing belt 32 for separating the sheet S easily from the fixing belt 32. The oil applying roller 36 includes a support shaft 36A rotatably supported in a mounting stays 16 through bearings (not shown) and a heat-resistant layer 36B of paper fitted over the support shaft 36A and impregnated with silicone coil. In this embodiment, the support shaft 36A comprises a shaft of iron having a diameter of 8 mm, and the heat-resistant layer 36B of paper is covered with a synthetic resin film 36C of porous fluoroplastics having a thickness of 100 μm. The oil applying roller 36 has a diameter of 14 mm. The oil app lying roller 36 thus constructed is capable of stably applying a small amount of silicone oil to the outer circumferential surface of the fixing belt 32.

{Description of tensioning mechanism for the fixing belt 32}

As a mechanism for tensioning the fixing belt 32, the fixing apparatus 10 is provided with a tension lever. The tension lever 38 is swingably supported to the mounting stays 16 at its lower end, and connected to one end of the mounting stays 16 at its upper end through a tension spring 52. By the urging force of the tension spring 52, the tension lever 38 is urged to rotate so as to contact with the outer circumferential surface of the heating roller 28 at its intermediate portion by a predetermined urging force F2.

Namely, the heating roller 28 urged by the urging force of the tension spring 52 through the tension lever 38 is biased to move so as to separate from the fixing roller 22. Thus, the upper run of the fixing belt 32 trained around the heating roller 28 and fixing roller 22 is restricted by the tension roller 36, thereby tensioning the fixing belt 32. When the fixing belt 32 is driven by the fixing roller 22, the fixing belt 32 is stably traveled without slipping or sagging upon the rotation of the fixing roller 22.

{Description of pressing mechanism between fixing roller 24 and pressing roller 24}

Next, a description of a pressing mechanism 54 for pressing the fixing belt 32 and pressing roller 24 with each other by a predetermined urging force at a position where the fixing belt 32 starts to be trained around the fixing roller 22, will be given. The pressing mechanism 54 is provided with a pressure lever 40 which is rotatably supported to the mounting stays 16 at one end through a supporting shaft 56 and capable of abutting against the core 24A of the pressing roller 24 from below, and a pressure spring 58 a lower end of which is coupled to the other end of the pressure lever 50 and an upper end of which is coupled to the upper portion of the mounting stay 16. By the urging force of the pressure spring 58, the pressure lever 40 contacts the outer circumferential surface of the core 24A of the pressing roller 24 by a predetermined force F1. As a result, the fixing belt 28 trained around the fixing roller 22 and the pressing roller 24 are contacted with each other by a predetermined urging force. That is to say, the fixing belt 32 and the pressing roller are rolling contacted with each other having a predetermined nip width.

Here, in the embodiment, a positional relationship between the fixing roller 22 and pressing roller 24 is set so that the pressing roller 24 is inclined by a predetermined angle in clockwise direction from a vertical line passing through the central position of the fixing roller 22. Thus, the nipping position between the fixing belt 32 and pressing roller 24 (that is, the central position of the nip width) is defined so as to biased forward (that is, to the left direction in drawing) in the feeding direction of the unfixed sheet S from a position just below the central position of the fixing roller 22 slightly.

{Description of thermistor}

The fixing apparatus 10 is provided with a thermistor 60 for controlling the temperature of the fixing belt 32. In the embodiment, the thermistor 60 is constructed to contact a non-passage portion of the fixing belt 32, that is, the right side portion of the fixing belt 32 which it directly trained around the heating roller 28, to detect the surface temperature thereof. In other words, the thermistor 60 is electrically connected to a control unit (not shown) to transmit the temperature information of the fixing belt 32 to the control unit.

{Description of experiment 1 where supporting member 30 is heated}

The preheat effect by the supporting member 30 to a fixibility of the unfixed toner at a condition where the heating roller 28 and pressing roller 24 are in a predetermined temperature condition in a case where the supporting member 30 was heated by the plate-like heater 34 was examined by an experiment 1 while measuring temperatures of the heating roller 28 and the pressing roller 24. In the experiment 1, date (that is, the glossiness) was measured where the feeding speed of the unfixed sheet S is set to be 120 mm/sec, the fixing pressure (that is, the pressure F1) is set to be 8 kgf/each side, and the width of the nipping region is set to be 4.5 mm.

The results from the experiment 1 is indicated in Table 2.

TABLE 2

| Temperature of heating roller | Temperature of pressing roller | Temperature of supporting member (° C.) | | | | |
|---|---|---|---|---|---|---|
| (° C.) | (° C.) | 22 | 50 | 80 | 110 | 140 |
| 140 | 22 | X | 18 | 23 | 28 | 36 |
| | 130 | X | 17 | 19 | 24 | 28 |
| | | | | (11) | (21) | (25) |
| 150 | 22 | X | 26 | 27 | 29 | 33 |
| | 140 | X | 16 | 20 | 25 | 27 |
| | | | | | (24) | (27) |
| 160 | 22 | — | 28 | 30 | 33 | 42 |
| | 150 | 21 | 24 | 23 | 29 | 35 |
| | | | (20) | (23) | (28) | (31) |
| 170 | 22 | X | 30 | 34 | 42 | 57 |
| | 160 | 24 | 24 | 33 | 37 | 49 |
| | | | (25) | (29) | (31) | (38) |
| 180 | 22 | — | | | | |
| | 170 | 29 | | | | |
| | | (29) | | | | |

In the Table 2, numerals denote the measured glossiness, and numerals circled by ○ indicate results in which the fixibility is good (the fixibilith is OK). Symbols × show results in which the low-temperature offset phenomenon was occurred. Furthermore, in a case where two-line numeral is described in one column, the upper numeral indicates measuring results of glossiness in a case of using sheets with a thickness corresponding to 55 kg/1,000 sheets, and the lower numeral denotes measuring results of glossiness in a case of using sheets with a thickness corresponding to 64 kg/1,000 sheets.

It should be noted that the glossiness is a mirror glossiness in 75 degrees in the present embodiment, measured by using glossimeter (GMX-type 202) manufactured by MURAKAMI SHIKISAI GIJUTSU KENKYUSHO Co., based on the method 2 defined in JIS Z8741.

From the results shown in the Table 2, it would be possible to lower the temperature of the heating roller 28 by 10° C. whereby the supporting member 30 is heated so that the temperature thereof is raised up by 30° C. Accordingly, it has been clear that it is possible to increase the feeding speed of the unfixed sheet S.

Figure 4:
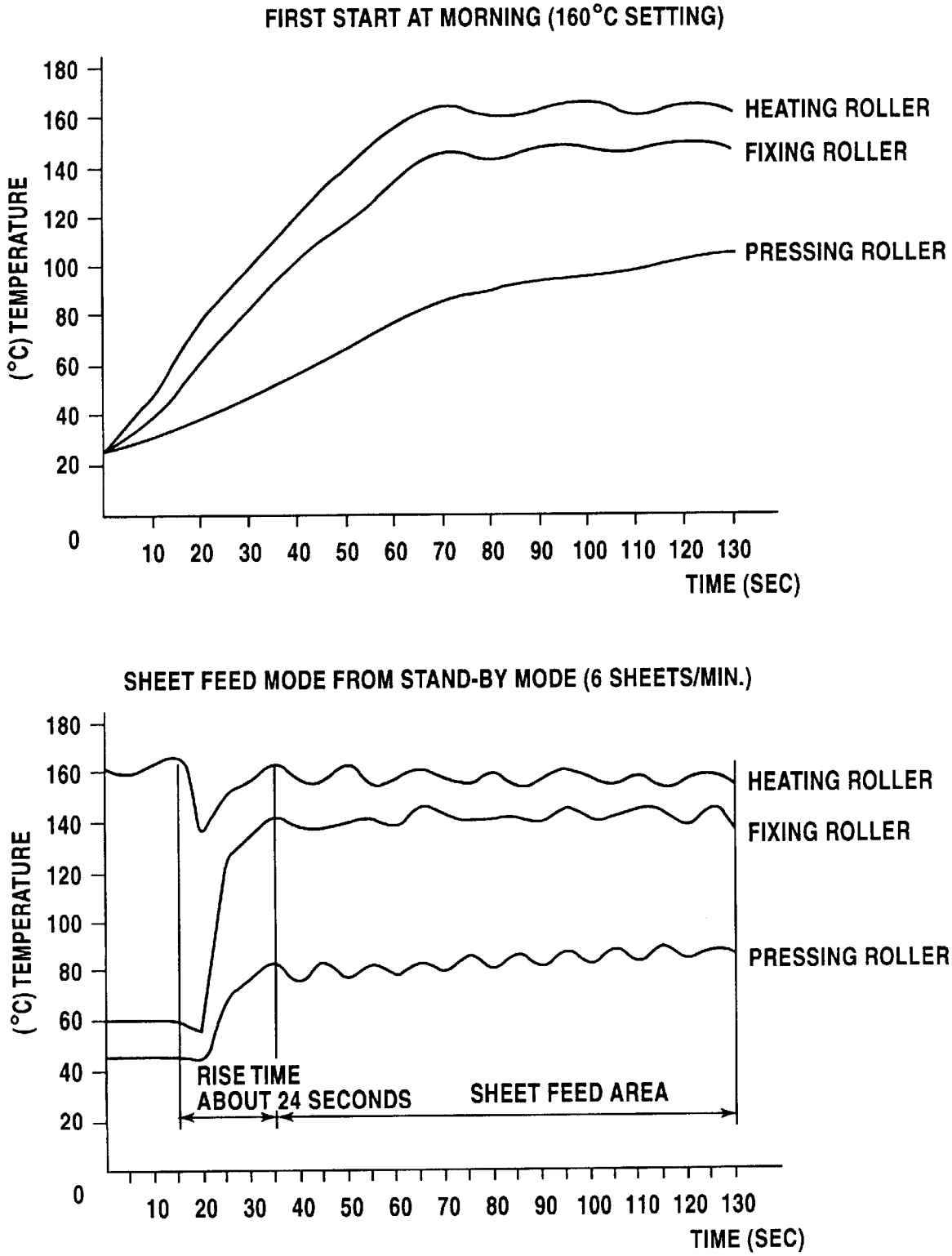
FIG. 4 is a graph showing temperature-time characteristics of the heating roller, the fixing roller and the pressing roller where the sheet feeding speed is set to be 40 mm/sec, in a case just after a warm up operation in the morning first is finished, and a case just after a warm up operation from a stand-by mode is finished, in a fixing apparatus with the fixing belt.
Figure 5:
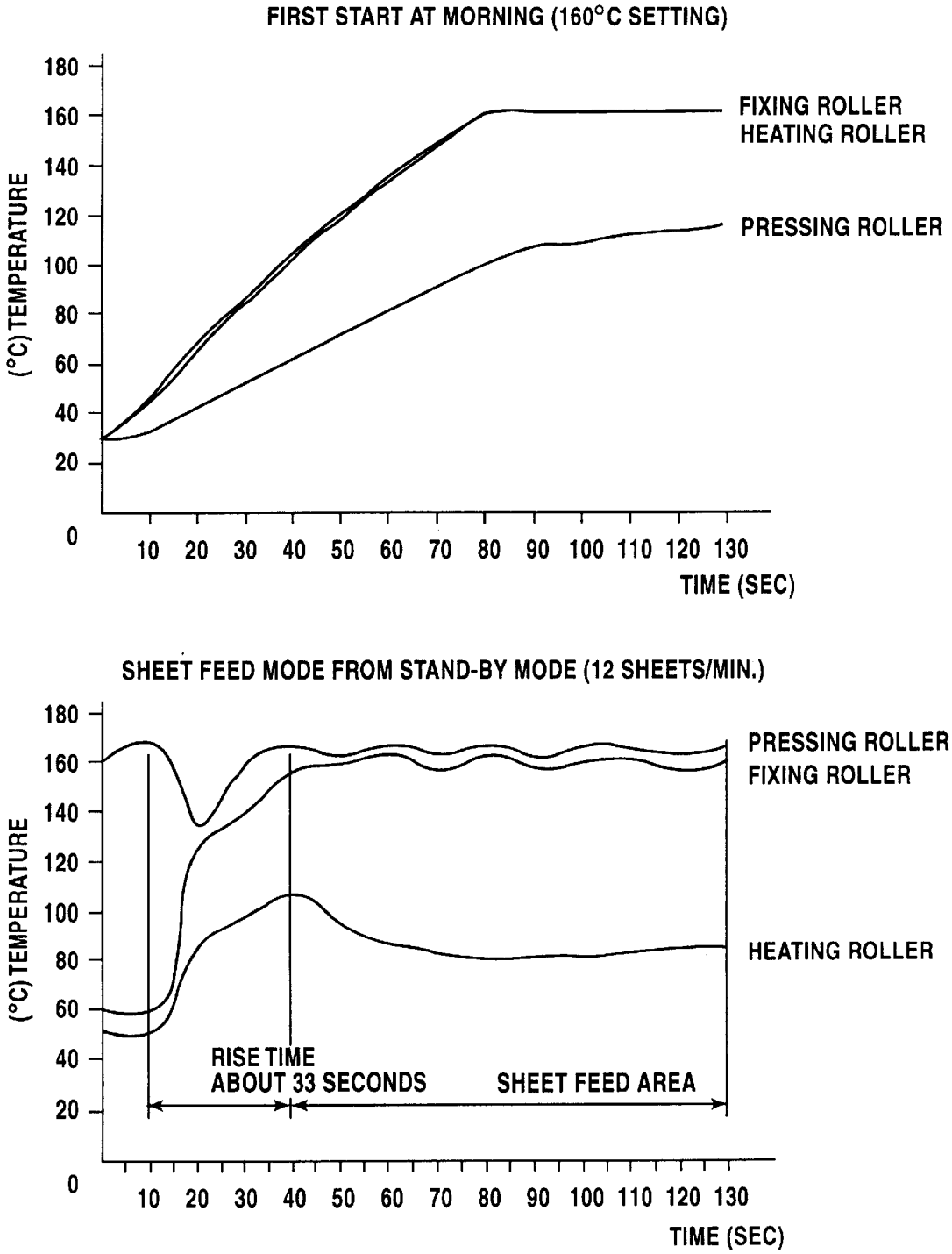
FIG. 5 is a graph showing temperature-time characteristics of the heating roller, the fixing roller and the pressing roller where that the sheet feeding speed is set to be 80 mm/sec, in a case just after a warm up operation in the morning first is finished, and in a case just after a warm up operation from a stand-by mode is finished, in a fixing apparatus with the fixing belt.
Figure 6:
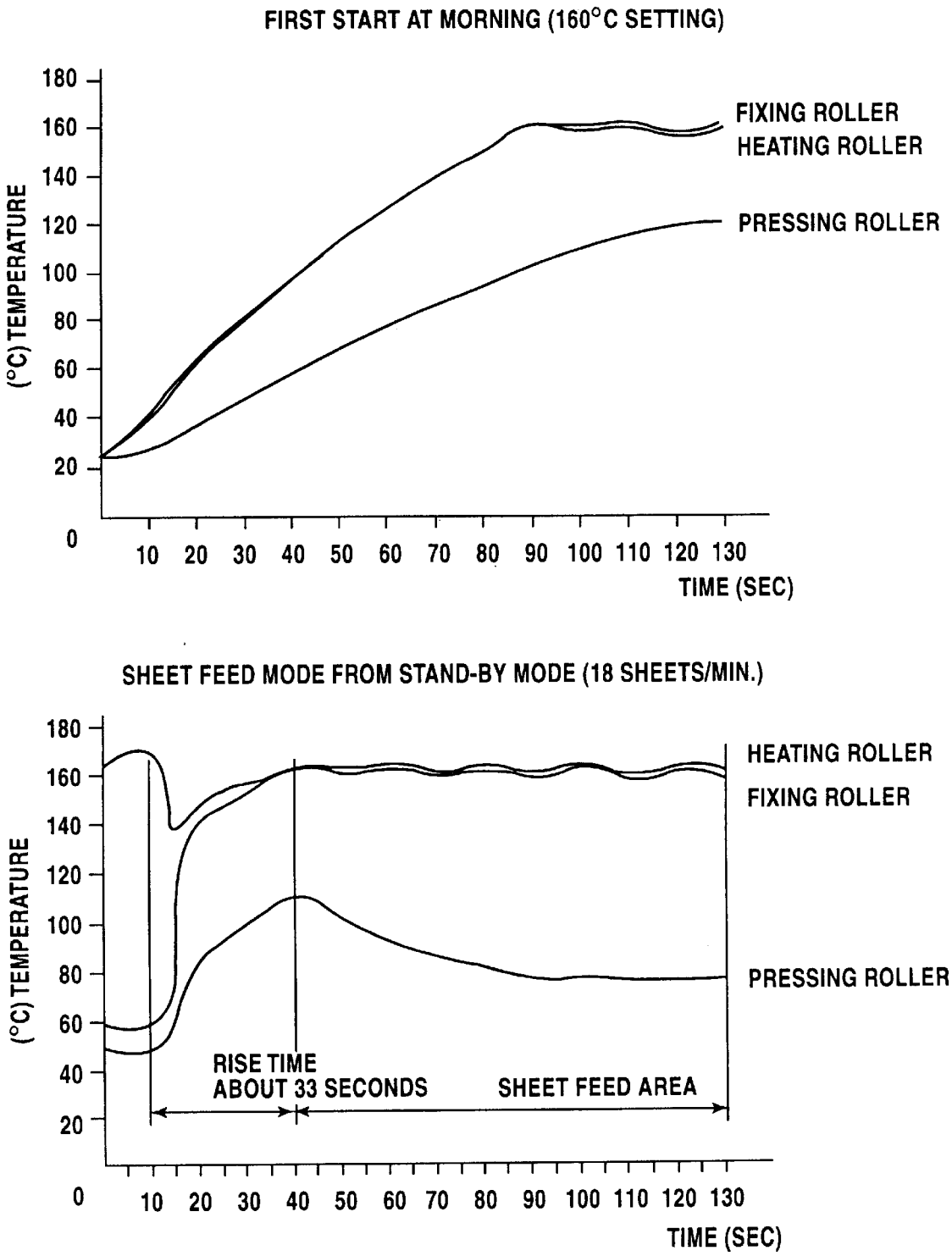
FIG. 6 is a graph showing temperature-time characteristics of the heating roller, the fixing roller and the pressing roller where the sheet feeding speed is set to be 120 mm/sec, in a case just after a warm up operation in the morning first is finished, and a case just after a warm up operation from a stand-by mode is finished, in a fixing apparatus with the fixing belt.
Figure 7:
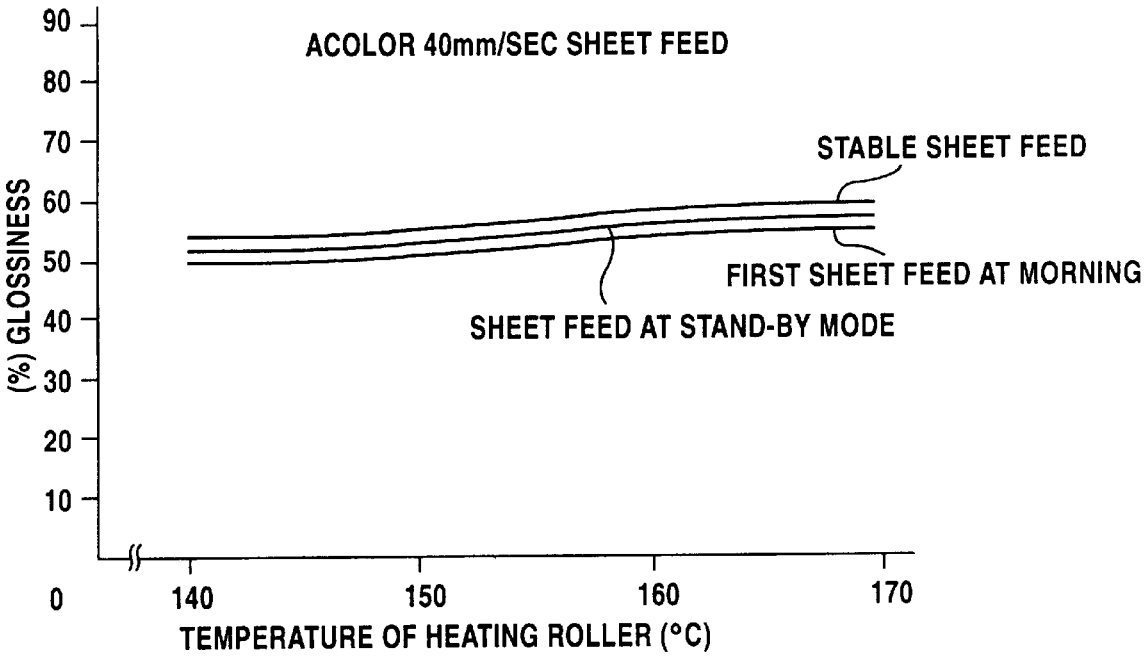
FIG. 7 is a graph showing a change of the glossiness of the sheet where the sheet feeding speed is set to be 40 mm/sec and the temperature of the heating roller is changed, in a case just after a warm up operation in the morning first is finished, a case just after a warm up operation from a stand-by mode is finished, and a case of stably feeding of the sheet, in the fixing apparatus according to the present invention.
Figure 7:
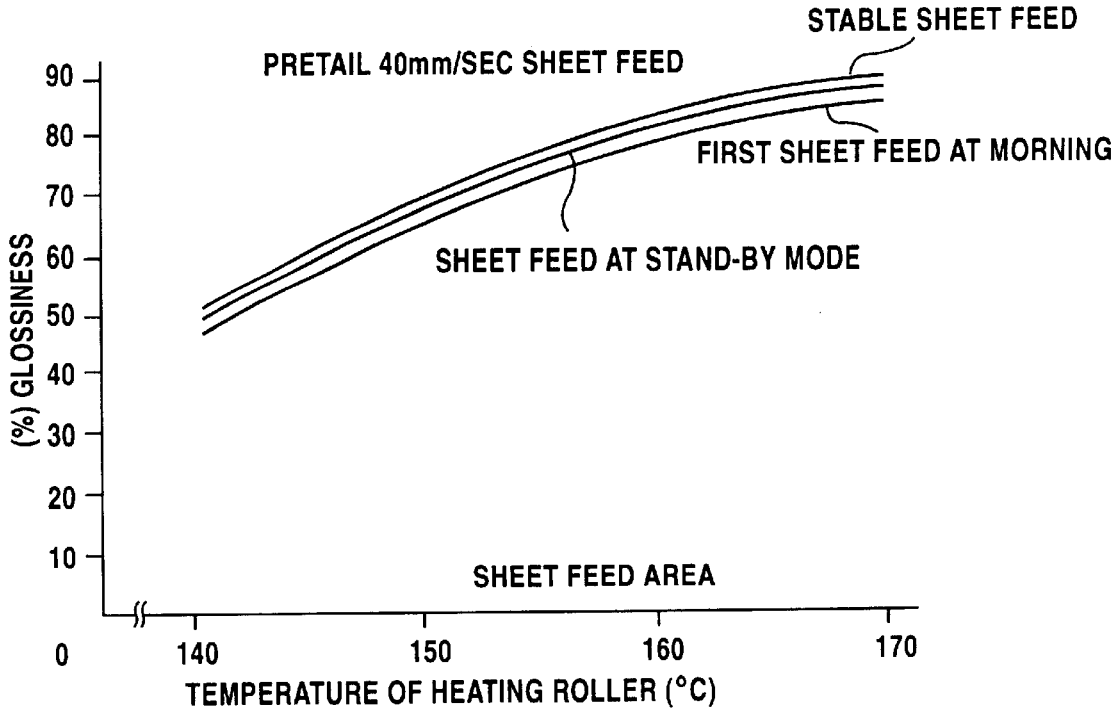
Figure 8:
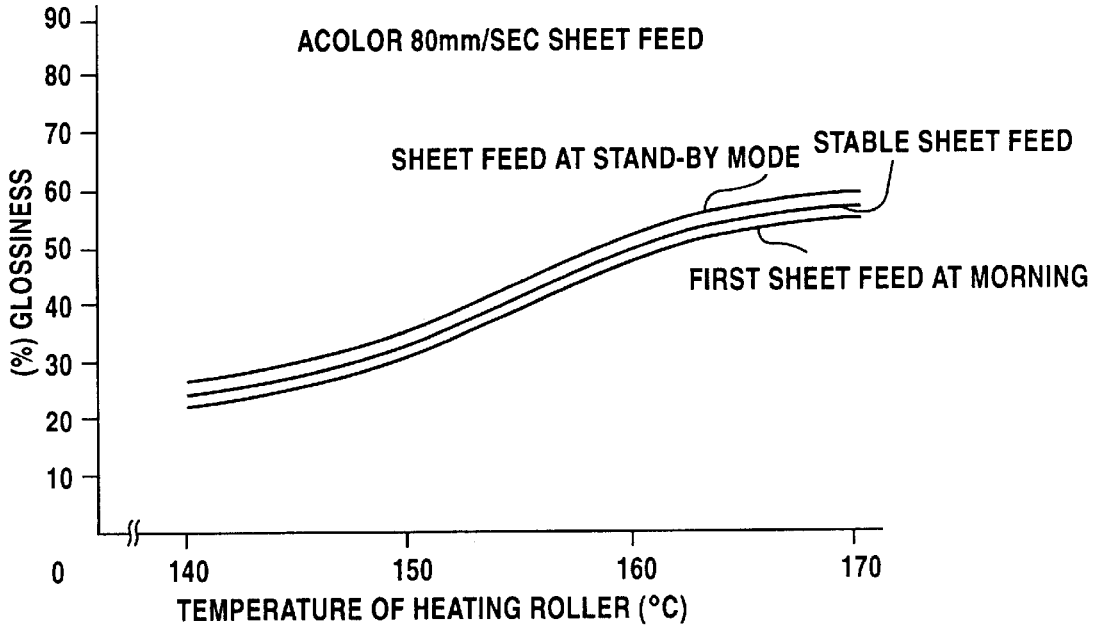
FIG. 8 is a graph showing a change of the glossiness of the sheet where the sheet feeding speed is set to be 80 mm/sec and the temperature of the heating roller is changed, in a case just after a warm up operation in the morning first is finished, a case just after a warm up operation from a stand-by mode is finished, and a case of stably feeding of the sheet, in the fixing apparatus according to the present invention.
Figure 8:
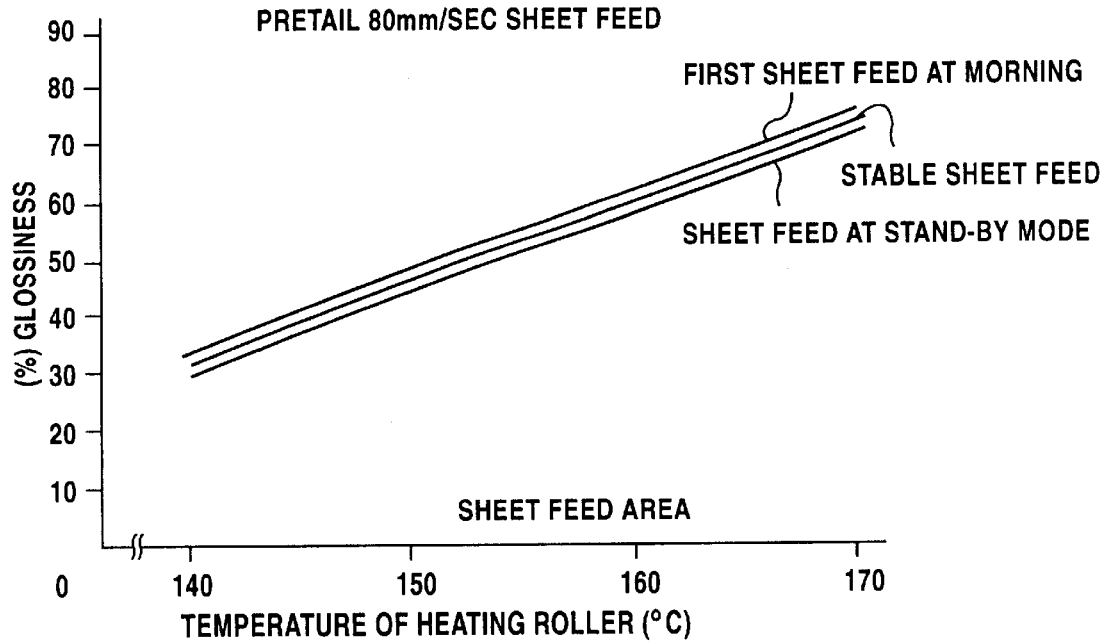
Figure 9:
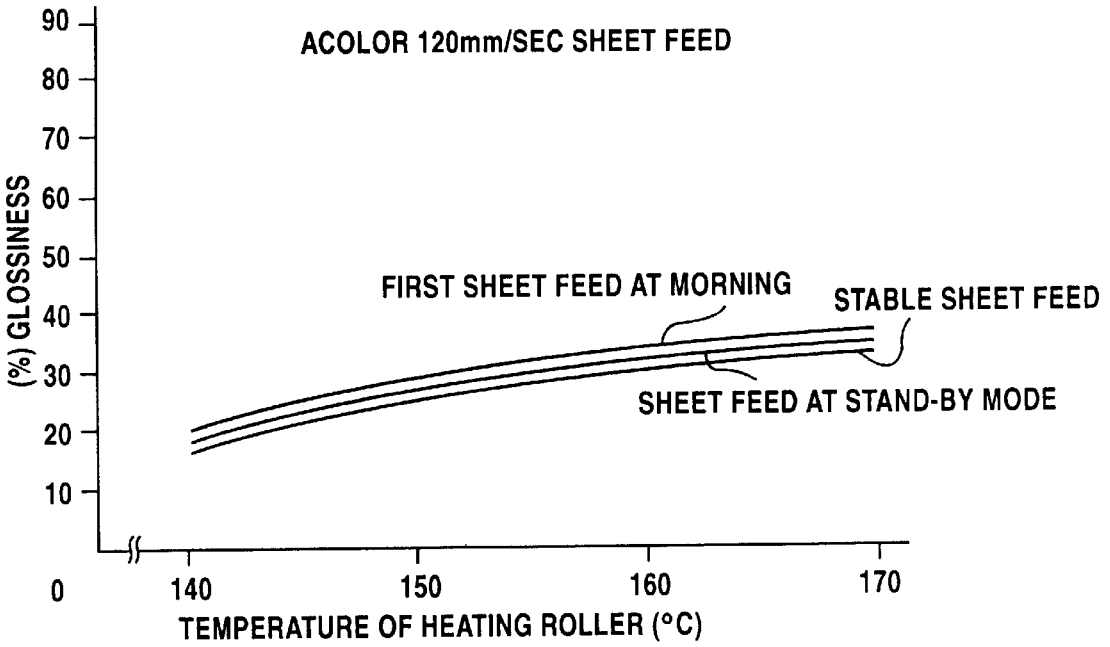
FIG. 9 is a graph showing a change of the glossiness of the sheet where the sheet feeding speed is set to be 120 mm/sec and the temperature of the heating roller is changed, in a case just after a warm up operation in the morning first is finished, a case just after a warm up operation from a stand-by mode is finished, and a case of stably feeding of the sheet, in the fixing apparatus according to the present invention.
Figure 9:
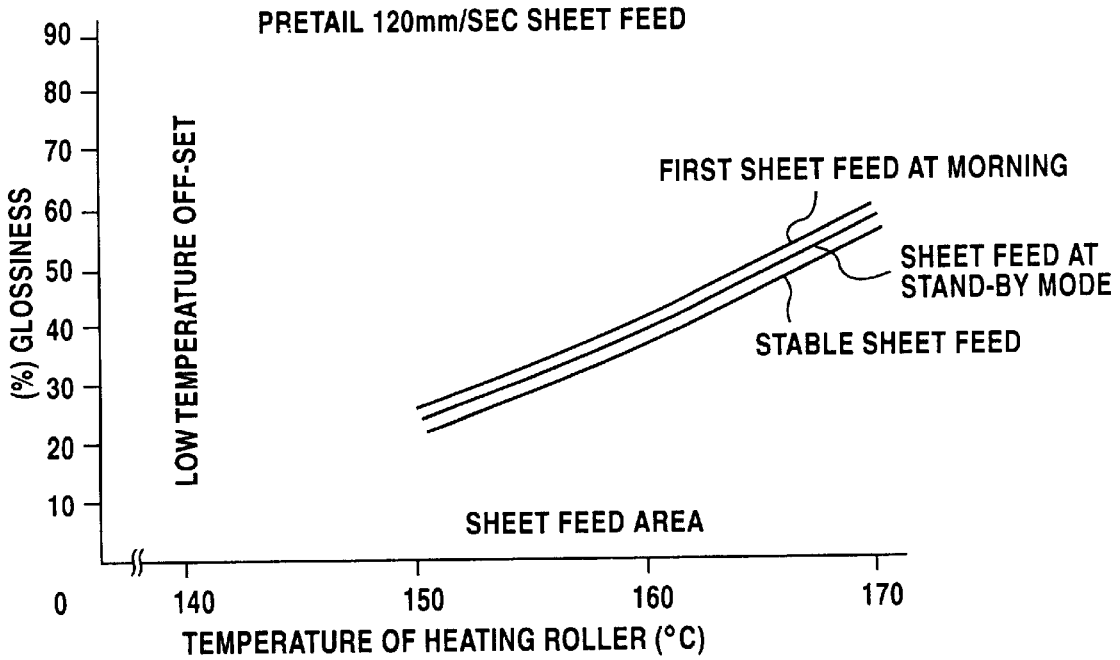

On the other hand, as well as previously described in the technical background of the present specification with reference to FIGS. 4 through 6, where fixing apparatuses each of which has temperature characteristics of the heating roller 28, the fixing roller 22 and the pressing roller 24, in a case that the sheet feeding speed is changed among 40 mm/sec, 80 mm/sec and 120 mm/sec, are utilized, the difference of glossiness of the fixed image on the sheets after passing through the nip portion among a case just after a warm up operation in the morning (that is, from a cold condition), a case just after a warm up operation from a stand-by mode (that is, from a condition in which the temperature of the fixing roller 22 is set below 60 (°C.)), and a case of a stable feeding mode (that is, just after the fixing apparatus has been actuated for 6 minutes), is little, as shown in FIGS. 7 through 9, respectively.

It should be noted that "Acolor" in FIGS. 7 through 9 shows the data in a case where the toner which is used in a copying machine of Acolor (Trade name of FUJI XEROX Co.) is utilized, while "Pretail" indicates the data in a case where the toner which is used in a copying machine of Pretail (Trade name of RICOH Co.) is utilized.

In other words, it is possible to accomplish the stable glossiness by preheating the supporting member 30 by the plate-like heater 34, even though the feeding speed is increased. That is to say, in the present embodiment, it is possible to increase the feeding speed with maintaining the good image quality, by preheating the supporting member 30.

Note that data shown in FIGS. 7 through 9 is a value in a case of using paper sheets with a thickness corresponding to 80 g/m$^2$, and the fixing pressure (that is, the pressure F1) is set to 6 kgf/each side, in the present experiment.

{Description of a modification of one embodiment}

It should be noted that the present invention is not limited to such a construction of the aforesaid embodiment, and a variety of modifications can be made without departing from the spirit and scope of the present invention.

For example, the fixing apparatus 10 has been described as being used in an electrophotographic copying system. However, the principles of the present invention are not limited to such an application, but are also applicable to other electronic image forming systems including an electronic facsimile machine, an electronic printer, etc.

Figure 10A:
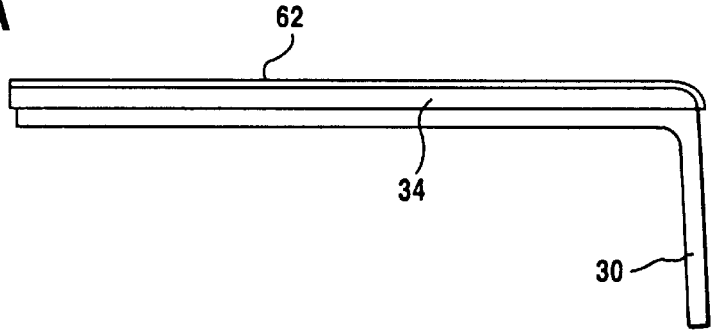
FIG. 10A is a front view of a first modification of the second heat generating means installed in the fixing apparatus according to the present invention.

The plate-like heater 34 as the second heat generating means has been described as being closely fitted to the undersurface of the supporting member 30. However, the principles of the present invention are not limited to such a construction, but are also closely fittable to the upper surface of the supporting member 30, as a first modification shown in FIG. 10A. In this case, the upper surface of the supporting member 30 is coated by an electro-conductive separating layer 62 such as PFA or PTFE. It should be noted that the same or similar member as the above embodiment will be added the same or similar reference numeral and the description thereof will be omitted.

Figure 10B:
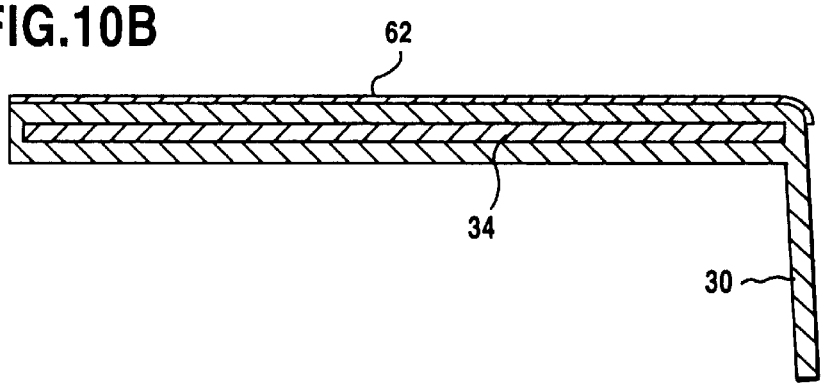
FIG. 10B is a front view of a second modification of the second heat generating means installed in the fixing apparatus according to the present invention.

The plate-like heater 34 has been described as being closed fitted to the surface of the supporting member 30. However, the principles of the present invention are not limited to such a construction, but may be embedded in the supporting member 30, as a second modification shown in FIG. 10B.

Figure 10C:
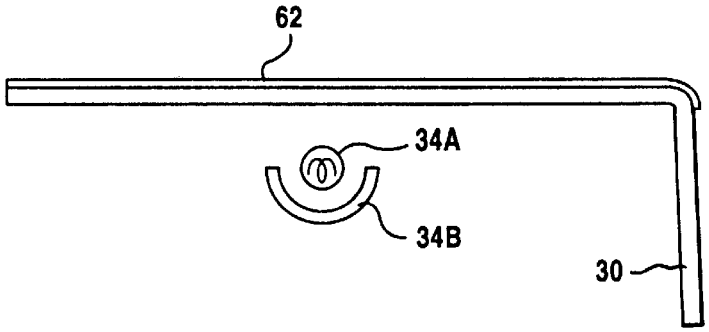
FIG. 10C is a front view of a third modification of the second heat generating means installed in the fixing apparatus according to the present invention.

The second heat generating means has been described as being constructed by the plate-like heater 34. However, the principles of the present invention are not limited to such a construction, but may comprise a halogen lamp 34A which is arranged being remote from the undersurface of the supporting member 30, and a reflecting plate 34B which is capable of reflecting the heat from the halogen lamp 34A to the undersurface of the supporting member 30, as a third modification shown in FIG. 10C.

Figure 10D:
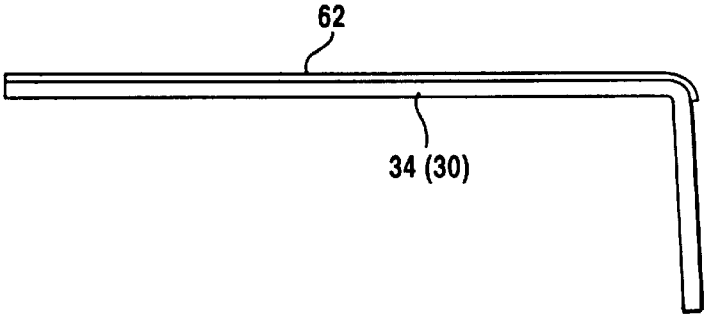
FIG. 10D is a front view of a fourth modification of the second heat generating means installed in the fixing apparatus according to the present invention.

The supporting member 30 and the heat generating source 34 have been described as being separated from each other. However, the principles of the present invention are not limited to such a construction, but the supporting member 30 may be formed by the plate-like heater itself, while the plate-like heater 34 as the second heat generating means may be formed in such a manner that the plate-like heater 34 can hold the predetermined shape thereof, as a fourth modification shown in FIG. 10D. In this case, the upper surface of the plate-like heater 34 as the supporting member 30 is coated by the electro-conductive separating layer 62.

Further in the embodiment, the fixing belt 32 has been described as including an endless belt base made of electroformed nickel and a heat-resistant resilient separating layer of silicone rubber that is coated on an outer circumferential surface of the endless belt base. However, the principles of the present invention are not limited to such a construction, but the fixing belt may include an endless belt base made of a synthetic resin such as a polyimide and a separating layer added to an outer circumferential surface of the endless belt base. In this case, the endless belt base may be formed of an electro-conductive synthetic resin such as an electro-conductive polyimide.

(Description of other embodiment}

Further in the above-mentioned embodiment, the heating roller 28 has been described as being arranged so as to be on a side of the fixing roller 22 (that is to say, on an upstream side of the fixing roller 22 with respect to the feeding direction of the unfixed sheet S), that is, so that a space between the supporting member 30 and the fixing belt 32 functions as a preheating passage P for preheating the unfixed sheet S. In other words, the heating roller 28 is positioned in such a manner that the unfixed sheet S passing through the preheating passage P is transferred within an area for affecting the preheat by heat radiated from the fixing belt 32. However, the principles of the present invention are not limited to such a construction, but the heating roller 28 may be positioned above the fixing roller 22 relative to the pressing roller 24, in other words, the heating roller 28 may be positioned in such a manner that the unfixed sheet is transferred out of the area for affecting the preheat by heat radiated from the fixing belt 32.

Hereinafter, a description will be given to a fixing apparatus 10' of the other embodiment according to the present invention in which the heating roller 28 is positioned above the fixing roller 22 (that is, so as to be remote from the fixing roller 22 in a direction crossing to the feeding direction of the unfixed sheet S), with reference to the accompanying FIGS. 11 through 14.

Figure 11:
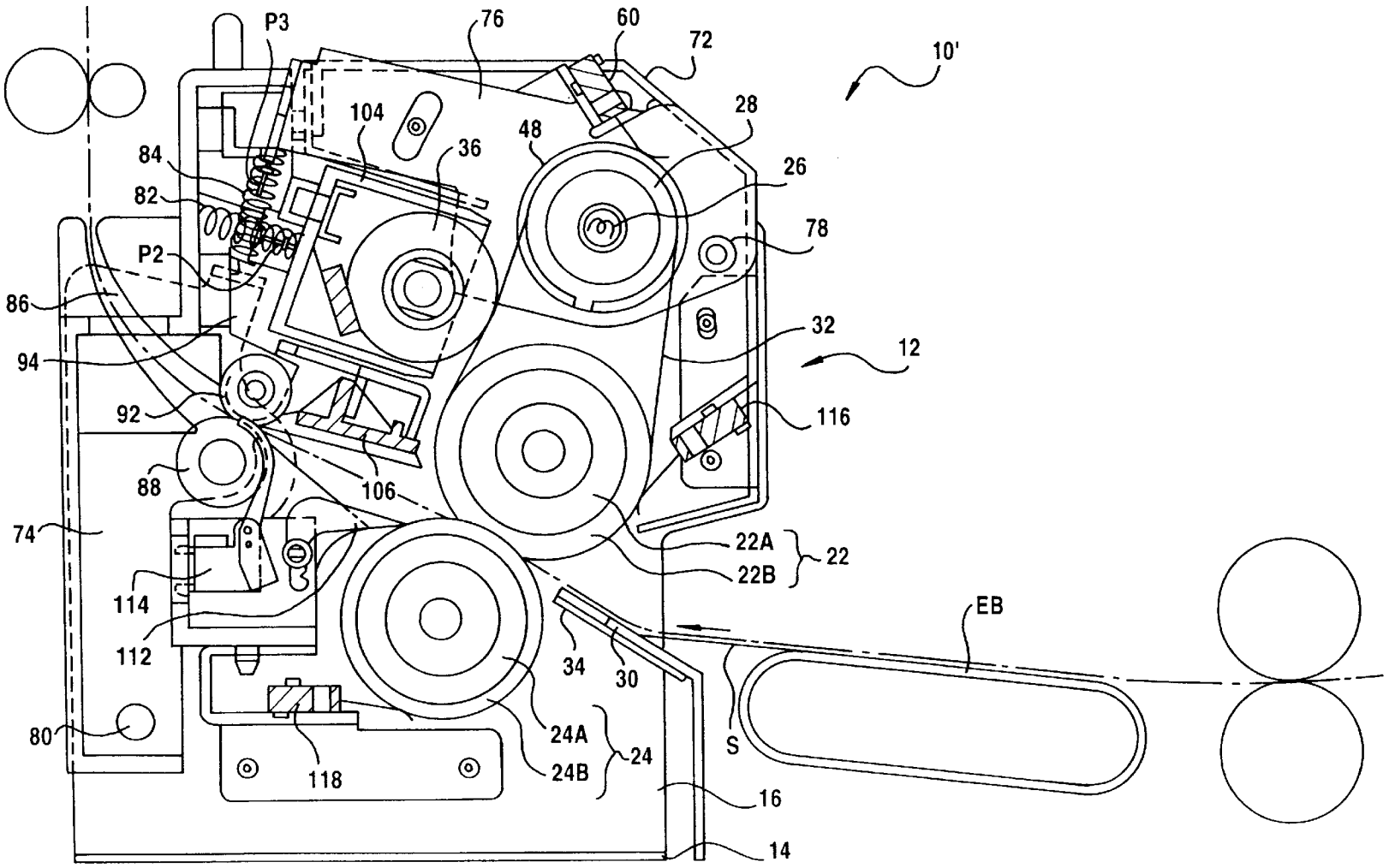
FIG. 11 is a sectional front elevational view of a fixing apparatus according to the other embodiment of the present invention.

As shown in FIG. 11, a fixing apparatus 10' according to the other embodiment of the present invention has a housing 12 which is the same as in the above one embodiment. The housing 12 comprises a base plate 14 to be fixed directly to the frame, a pair of vertical side plates (main mounting stays) 16 erected from respective side edges of the base plate 14, auxiliary mounting stays which are the same in the above one embodiment, an upper cover 72 mounted on the side plates 16 to cover upper right regions of the side plates 16, and a left cover 74 mounted on the side plates 16 to cover left side regions of the side plates 16.

The upper cover 72 is fixedly mounted on the side plates 16. A swing lever 76 is swingably supported on right portions of the side plates 16 by a first pivot shaft 78 positioned on a right end of the swing lever 76, for swinging movement about the first pivot shaft 78 to provide an open space at a left end of the swing lever 76. The left cover 74 is swingably supported on the side plates 16 by a second pivot shaft 80 positioned on a lower end of the left cover 74, for swinging movement about the second pivot shaft 78 to provide an open space at an upper end of the left cover 74.

The fixing apparatus 10' has a roller assembly including a fixing roller 22 rotatably supported on the side plates 16 for rotation about a fixed axis, a pressing roller 24 positioned obliquely downwardly of the fixing roller 22 in rolling contact with the fixing roller 22 and rotatably supported on the side plates 16 for rotation about a fixed axis parallel to the fixed axis of the fixing roller 22, and a heating roller 28 positioned obliquely upwardly of the fixing roller 22 and rotatably supported on the swing lever 76 for rotation about its own axis. The heating roller 28 has a heater 26 such as a halogen lamp or the like disposed therein.

The fixing apparatus 10' has a belt assembly including an endless fixing belt (heat transfer belt) 32 which is trained around the fixing roller 22 and the heating roller 28.

Figure 12:
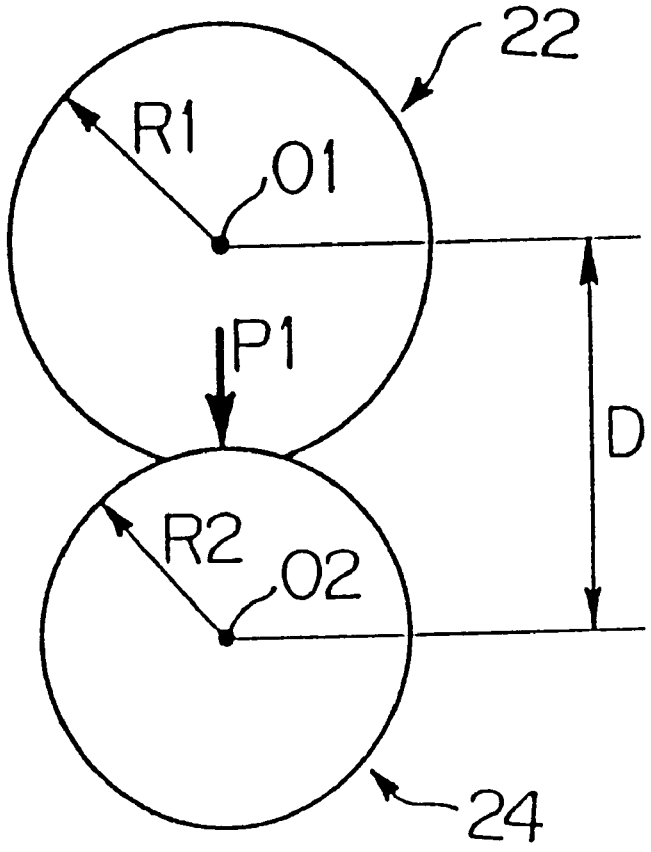
FIG. 12 is a schematic view showing the manner in which a fixing roller and a pressing roller are held in rolling contact with each other in the other embodiment shown in FIG. 11.

Here, although the detail will be described later, the fixing roller 22 comprises a resilient roller, and the pressing roller 24 comprises a roller harder than the fixing roller 22. As shown in FIG. 12, the fixing roller 22 and the pressing roller 24 have respective centers O1, O2 spaced from each other by a distance D which is slightly smaller than the sum (R1+R2) of their radii R1, R2 (that is, D<R1+R2). In a rolling contact region (nipping region) between the fixing roller 22 and the pressing roller 24, the fixing roller 22 and the pressing roller 24 are held in rolling contact with each other under a predetermined pressure P1, so that the fixing roller 22 has an outer circumferential surface made partly concave by the pressing roller 24 held in rolling contact therewith, thus providing a sufficient nipping width in a direction across the axes of the fixing roller 22 and the pressing roller 24.

The fixing apparatus 10' also has an oil applying roller 36 for applying silicone oil to an outer circumferential surface of the fixing belt 32 and cleaning the outer surface of the fixing belt 32, a first helical spring 82 for normally pressing the oil applying roller 36 against the fixing belt 32 perpendicularly thereto to tension the fixing belt 32, and a second helical spring 84 for normally urging the heating roller 28 in a direction away from the fixing roller 22 to tension the fixing belt 32 in coaction with the first helical spring 82.

A sheet discharge passage 86 is defined above the left cover 74 for discharging a sheet with a toner image fixed thereto with heat and pressure by the fixing roller 22 and the pressing roller 24 in the rolling contact region. Such a sheet will hereinafter be referred to as a "fixed toner sheet". The sheet discharge passage 86 is oriented such that it discharges the fixed toner sheet substantially upwardly along a vertical plane.

A lower discharge roller 88 is rotatably mounted on the left cover 74 between the sheet discharge passage 86 and the rolling contact region. The lower discharge roller 88 is actuated by an actuating mechanism 90 (described later on) to rotate at a speed greater than the pressing roller 24, i.e., at a speed which is 5% greater than the speed at which the pressing roller 24 rotates. An upper discharge roller 92 is positioned obliquely upwardly of the lower discharge roller 88 and held in rolling contact with the lower discharge roller 88 under resilient forces from a leaf spring 94. It should be noted the upper discharge roller 92 is positioned with respect to the lower discharge roller 88 such that a line interconnecting the centers of the upper and lower discharge rollers 92, 88 extends substantially perpendicularly across a sheet discharge passage along which the fixed toner sheet is delivered from the rolling contact region to the sheet discharge passage 86.

In the fixing apparatus 10' thus constructed, the unfixed toner sheet S fed onto the supporting member 30 by the endless belt EB has its lower surface, opposite to the unfixed toner image, borne by supporting member 30, and is guided by the supporting member 30 toward the rolling contact region (nipping region) between the fixing roller 22 and the pressing roller 24, with the fixing belt 32 being trained around the fixing roller 22. When the unfixed toner sheet S passes under pressure between the fixing roller 22 and the pressing roller 24, the unfixed toner image is fixed to the sheet S with heat and pressure.

{Description of fixing roller 22}

The fixing roller 22 comprises a core 22A rotatably supported on the side plates 16 by bearings (not shown) and a roller sleeve 22B fitted coaxially over the core 22A. The fixing belt 32 is trained around the roller sleeve 22B. The fixing roller 22 has an outside diameter of 38.5 mm in this embodiment. The core 22A comprises a shaft of iron having a diameter of 25 mm, and the roller sleeve 22B is made of a heat-resistant resilient material of silicone rubber having a wall thickness of 6.75 mm. Specifically, the roller sleeve 22B is made of silicone rubber sponge having an JIS A hardness of 15 degrees.

Figure 13:
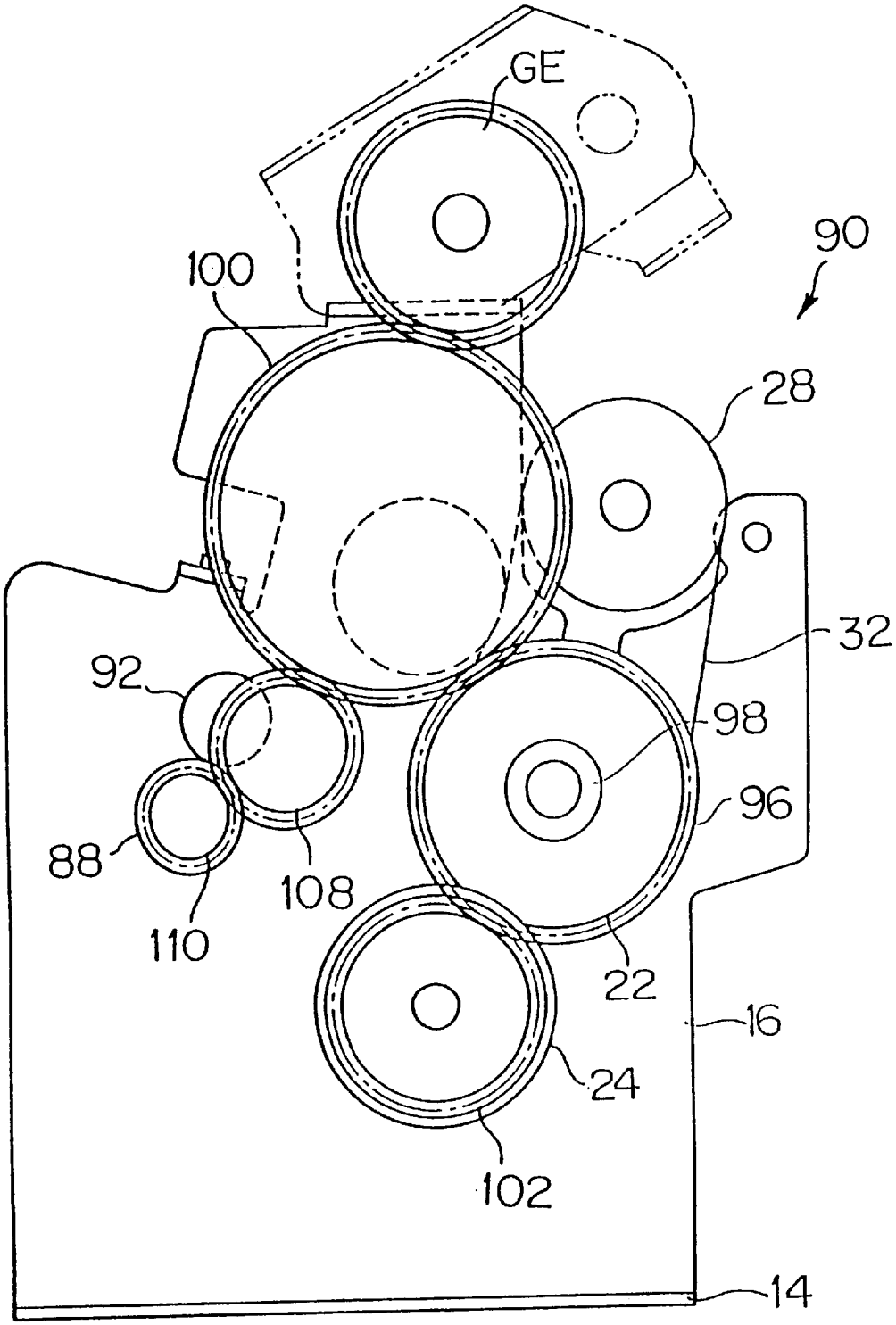
FIG. 13 is a schematic front elevational view of an actuating mechanism in the other embodiment shown in FIG. 11.

As shown in FIG. 13, the core 22A has an end combined with a shaft which is coaxially coupled to a first driven gear 96 through a one-way clutch 98 (described later on). The first driven gear 96 is held in mesh with a transmission gear 100 of the actuating mechanism 90. Drive forces produced by the actuating mechanism 90 are transmitted through the transmission gear 100 to the first driven gear 96 which is rotated clockwise to rotate the fixing roller 22 through the one-way clutch 98.

{Description of pressing roller 24}

The pressing roller 24 comprises a core 24A rotatably supported on the side plates 16 by bearings (not shown) and a roller sleeve 24B fitted coaxially over the core 24A. The pressing roller 24 has an outside diameter of 35 mm in this embodiment. The core 24A comprises a shaft of iron having a diameter of 32 mm, and the roller sleeve 24B is made of a heat-resistant resilient material of silicone rubber having a wall thickness of 1.5 mm. Specifically, the roller sleeve 24B is made of silicone rubber sponge having a JIS A hardness of 20 degrees, which is harder than the roller sleeve 22B of the fixing roller 22. The outer circumferential surface of the roller sleeve 24B is covered with a tube of fluoroplastics having a wall thickness of 50 μm.

The core 24A has an end combined with a shaft which is coaxially coupled to a second driven gear 102 which is held in mesh with the first driven gear 96. Drive forces are transmitted from the first driven gear 96 to the second driven gear 102, which rotates the pressing roller 24 counterclockwise.

In this embodiment, the pressing roller 24 is used as a primary drive roller for establishing a speed at which the unfixed toner sheet is fed through the nipping region. The ratio of gear teeth of the first and second drive gears 96, 102 is selected such that the peripheral speed of the fixing roller 22 as it is thermally expanded is not greater than the peripheral speed of the pressing roller 24, as shown in FIG. 13. Specifically, the speed at which the fixing roller 22 is rotated by the first driven gear 96 is slightly lower than the speed at which it is rotated in frictional engagement with the pressing roller 24 through the fixing belt 32.

On the other hand, the pressing roller 24 is not positioned directly downwardly of the fixing roller 22, but is displaced downstream in the feed direction of a position directly downward of the fixing roller 22. Specifically, the pressing roller 24 is positioned with respect to the fixing roller 22 such that an acute angle is formed between a vertical line passing through the center of the fixing roller 22 and a line segment passing through the centers of the fixing roller 22 and the pressing roller 24. The line segment passing through the centers of the fixing roller 22 and the pressing roller 24 extends perpendicularly to the feed direction across the rolling contact region.

{Description of supporting member 30}

The upper cover 72 has a right lower portion bent inwardly into the housing 12. A supporting member 30 is positioned below and largely spaced from the bent right lower portion of the upper cover 72. The supporting member 30 and the bent right lower portion of the upper cover 72 jointly define an inlet port 46 therebetween for introducing therethrough a sheet S with an unfixed toner image carried thereon into the housing 12 in the direction (feed direction) indicated by the arrow in FIG. 11.

The supporting member 30 is inclined obliquely upwardly to the left such that the height of the supporting member 30 progressively increases into the housing 12. The supporting member 30 has an inlet end, i.e., a right end, positioned in confronting relation to an outlet end of a sheet feeding endless belt EB that is positioned in the electrophotographic copying system adjacent to the right end of an inlet port. The supporting member 30 has an outlet end, i.e., a left end, positioned in confronting relation to the rolling contact region (nipping region) between the fixing roller 22 and the pressing roller 24.

When the unfixed toner sheet S is fed in the feed direction indicated by the arrow toward the toner image fixing apparatus 10' by the endless belt EB, the leading end of the unfixed toner sheet S contacts the supporting member 30, and is then guided thereby to travel obliquely upwardly into the rolling contact region between the fixing roller 22 and the pressing roller 24.

A plate-like heater 34 (so-called panel heater) for heating the supporting member 30 is arranged on the under surface of the supporting member 30 as a second heat generating means, with the same manner as the first embodiment.

{Description of one-way clutch 98}

The one-way clutch 98 allows the fixing roller 22 to rotate clockwise relatively to the first driven gear 96, but prevents the fixing roller 22 from rotating counterclockwise relatively to the first driven gear 96, i.e., rotates the fixing roller 22 and the first driven gear 96 in unison with each other. Specifically, when the fixing roller 22 is cold, i.e., when the fixing roller 22 and the fixing belt 32 are driven by the pressing roller 24 while the fixing belt 32 is held in frictional engagement with the pressing roller 24 and the fixing roller 22 is held in frictional engagement with the fixing belt 32, the peripheral speed of the fixing roller 22 upon clockwise rotation thereof is the same as the peripheral speed of the pressing roller 24, and hence is slightly higher than the peripheral speed of the first driven gear 96. The difference between the peripheral speeds of the fixing roller 22 and the first driven gear 96 is absorbed by the one-way clutch 98.

When the heating roller 28 is heated by the heater 26 and the fixing roller 22 is heated through the fixing belt 32, the outside diameter of the fixing roller 22 is increased as it is thermally expanded, and the peripheral speed of the fixing roller 22 increases. Since the peripheral speed of the fixing roller 22 does not become higher than the peripheral speed of the pressing roller 24, the increase in the peripheral speed of the fixing roller 22 is absorbed by the one-way clutch 98.

The one-way clutch 98 offers the following advantages: If the one-way clutch 98 were not employed, when a sheet with a glossy and slippery surface, such as a coated sheet, is fed as an unfixed toner sheet into the rolling contact region, the fixing belt 32 would slip against the unfixed toner sheet, and drive forces would not be transmitted from the pressing roller 24 to the fixing belt 32 and the fixing roller 22, which would not then be driven by the pressing roller 24. Therefore, the unfixed toner sheet would be jammed in the rolling contact region, or even if the unfixed toner sheet passed through the rolling contact region, the unfixed toner image on the unfixed toner sheet would be abraded and disturbed by the fixing belt 32 kept at rest.

In this embodiment, however, since the one-way clutch 98 is connected between the fixing roller 22 and the first driven gear 96, even if drive forces from the pressing roller 24 are not transmitted to the fixing belt 32, the fixing roller 22 is rotated clockwise by the first driven gear 96 through the one-way clutch 98 when the peripheral speed of the fixing roller 22 starts being lower than the peripheral speed of the first driven gear 96. Therefore, the unfixed toner sheet passes reliably through the rolling contact region for effective protection against a sheet jam in the nipping region and toner image disturbance on the sheet.

{Description of fixing belt 32}

In this embodiment, the fixing belt 32 comprises an endless belt base of an electro-conductive polyimide having a thickness of 100 μm and an inner diameter of 60 mm, and a heat-resistant resilient separating layer of silicone rubber that is coated to a thickness of 200 μm on an outer circumferential surface of the endless belt base.

Alternatively, the fixing belt 32 may comprise an endless belt base of electroformed nickel and a heat-resistant resilient separating layer of silicone rubber that is coated on an outer circumferential surface of the endless belt base.

{Description of tensioning mechanism for the fixing belt 32}

As described above, a mechanism for tensioning the fixing belt 32 has the first helical spring 82 for normally pressing the oil applying roller 36 against the fixing belt 32 perpendicularly thereto to tension the fixing belt 32, and the second helical spring 84 for normally urging the heating roller 28 in a direction away from the fixing roller 22 to tension the fixing belt 32 in coaction with the first helical spring 82.

The first helical spring 82 is attached to the left cover 74 for normally urging the casing 104, on which the oil applying roller 36 is rotatably supported, toward the fixing belt 32. The casing 104 is movably supported by a guide rib 106 on one of the side plates 16 for movement toward and away from the fixing belt 32. When the left cover 74 is swung open to the left about the second pivot shaft 80, the first helical spring 82 is disengaged from the casing 104, releasing the oil applying roller 36 from the fixing belt 32. When the left cover 74 is swung to the right about the second pivot shaft 80, the first helical spring 82 pushes the casing 104 under a pressing force P2, causing the oil applying roller 36 to press the fixing belt 32 under a certain tension.

On the other hand, the second helical spring 84 is connected between the left end of the swing lever 76 and the side plate 16 for normally urging the swing lever 76 to turn clockwise about the first pivot shaft 78, i.e., to push the heating roller 28 on the swing lever 76 under a third pressing force P3 in a direction away from the fixing roller 22. In this manner, the fixing belt 32 is given a desired tension.

Therefore, the heating roller 28 is displaced away from the fixing roller 22 by the swing lever 76 under the bias of the second helical spring 84, tensioning the fixing belt 32 trained around the heating roller 28 and the fixing roller 22.

The fixing belt 32 thus tensioned by the first and second helical springs 40, 42 is held in frictional engagement with the pressing roller 24 and driven thereby. When the fixing belt 32 is driven by the pressing roller 24, the fixing roller 22 is stably driven thereby without slipping or sagging with respect to the fixing belt 32.

{Description of actuating mechanism 90}

As shown in FIG. 13, the actuating mechanism 90 for rotatably driving the pressing roller 24 includes the transmission gear 100 which is held in mesh with an output gear GE that is connected through a gear train (not shown) to an actuator in the electrophotographic copying system when the fixing apparatus 10' is installed in the electrophotographic copying system. The transmission gear 100 can be driven to rotate by the output gear GE. The actuating mechanism 90 also has, in addition to the transmission gear 100, the first driven gear 96 held in mesh with the transmission gear 100 and coupled to the fixing roller 22 through the one-way clutch 98, and the second driven gear 102 held in mesh with the first driven gear 96 and fixed coaxially to the pressing roller 24.

The actuating mechanism 90 also has an idler gear 108 held in mesh with the transmission gear 100. The idler gear 108 is also held in mesh with a third driven gear 110 fixed coaxially to the lower discharge roller 88 for rotating the lower discharge roller 88 at a speed equal to or higher than the rotational speed of the pressing roller 24.

{Description of other structural details}

As shown in FIG. 11 again, the fixing apparatus 10' has a peeler blade 112 for peeling the fixed toner sheet off the outer circumferential surface of the pressing roller 24, and a sheet sensor 114 for detecting the leading end of the fixed toner sheet as it is fed to a rolling contact region between the upper and lower discharge rollers 88 and 92.

The fixing apparatus 10' further includes a thermistor 60 for detecting the temperature of that portion of the fixing belt 32 which is trained around the heating roller 28, a second thermistor 116 for detecting the temperature of that portion of the outer circumferential surface of the fixing belt 32 which is trained around the fixing roller 36, a third thermistor 118 for detecting the temperature of the outer circumferential surface of the pressing roller 84, and a control circuit (not shown) for controlling the heater 26 and the plate-like heater 34 based on the temperatures detected by the first, second, and third thermistors 60, 116 and 118.

{Description of position of the heating roller 28}

As described above, the heating roller 34 is positioned substantially upwardly of the fixing roller 22. Therefore, the fixing belt 32 that is trained around the fixing roller 22 and the heating roller 28 is so spaced from the supporting member 30 that the unfixed toner sheet fed on the supporting member 30 will not be brought into contact with the fixing belt 32. Stated otherwise, the fixing belt 32 is disposed in a position outside of a region where the unfixed toner sheet fed on the supporting member 30 possibly passes.

Because the heating roller 34 is positioned substantially upwardly of the fixing roller 22, the unfixed toner sheet S carried on the upper surface of the supporting member 30 is reliably prevented from contacting the fixing belt 32 irrespective of how the unfixed toner sheet being fed may be curled. Consequently, the unfixed toner sheet S can be led to the rolling contact region between the fixing roller 22 and the pressing roller 24 without disturbing the unfixed toner image on the unfixed toner sheet S, so that the unfixed toner image on the unfixed toner sheet S can reliably be fixed to the unfixed toner sheet S in the rolling contact region.

{Description of angle of the heating roller 28}

Figure 14:
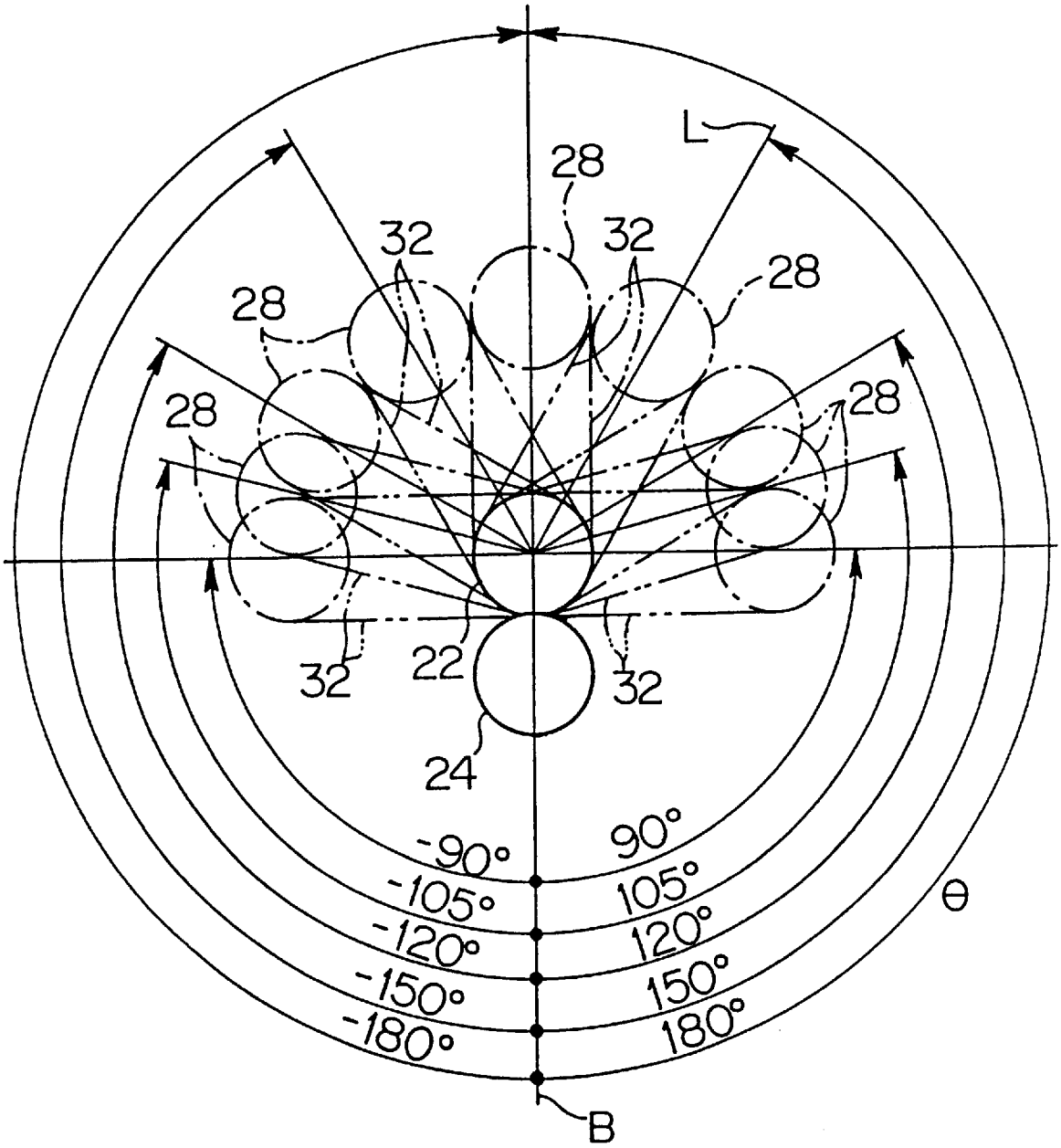
FIG. 14 is a diagram showing angles employed in an experiment conducted to check an allowable range of positions of a heating roller with respect to the fixing roller in the other embodiment shown in FIG. 11.

The fact that the heating roller 28 is positioned substantially upwardly of the fixing roller 22 offers advantages inherent in the fixing apparatus 10'. An experiment to determine an optimum angular range in which the heating roller 28 can be positioned substantially upwardly of the fixing roller 22 by changing the angle of the heating roller 28 as shown in FIG. 14 will be described below.

In the experiment, a straight line passing through the centers of the fixing roller 22 and the pressing roller 24 was defined as a reference line B, and an angle θ was defined between the reference line B and a line segment L interconnecting the centers of the fixing roller 22 and the heating roller 28. The angular position of the heating roller 28 with respect to the fixing roller 22 was changed to change the angle θ between 90° and 180°, and the frequency of rubbed states of toner images at the inlet of the rolling contact region between the fixing roller 22 and the pressing roller 24 and also the frequency of defects of toner images at the outlet of the rolling contact region between the fixing roller 22 and the pressing roller 24 were measured when the toner images were copied on one side and both sides of sheets.

The angle θ was defined as a positive angle when measured counterclockwise from the reference line B, and as a negative angle when measured clockwise from the reference line B. Therefore, the heating roller 28 positioned at the angle θ=+180° and the heating roller 28 positioned at the angle θ=−180° were in the same angular position, and the heating roller 28 positioned at the angle θ=+105° and the heating roller 28 positioned at the angle θ=−255° were in the same angular position. Defects of toner images at the outlet of the rolling contact region represent sheet offsets or sheet jams.

The experiment was conducted under the following conditions:

The nipping width in the rolling contact region was set to 8 mm, and the pressing roller 24 applied a pressure P1 of 24 kgf to one side of the unfixed toner sheet S. The temperature of the fixing belt 32 trained around the fixing roller 22 was set to 160° C. The surface temperature of the pressing roller 24 was set to 140° C. The speed at which to feed the unfixed toner sheet S was set to 180 mm/sec. The pressing roller 24 was rotated in synchronism with the speed of 180 mm/sec. The toner used was an Acolor toner manufactured by Fuji Xerox Co. The sheet S used was plain paper having a weight of 64 g/m$^2$.

The experiment was made for nine angles θ of 90°, 105°, 120°, 150°, 180°, −150°, −120°, −105°, and −90°.

The results of the experiment are given in Table 3 shown below.

TABLE 3

| | Copied on one side | | Copied on both sides | | |
|---|---|---|---|---|---|
| Angles | A | B | A | B | Evaluation |
| 90° | 3/5 | 0/5 | 5/5 | 0/5 | Not acceptable |
| 105° | 0/5 | 0/5 | 1/5 | 0/5 | Partly acceptable |
| 120° | 0/5 | 0/5 | 0/5 | 0/5 | Acceptable |
| 150° | 0/5 | 0/5 | 0/5 | 0/5 | Acceptable |
| ±180° | 0/5 | 0/5 | 0/5 | 0/5 | Acceptable |
| −150° | 0/5 | 0/5 | 0/5 | 0/5 | Acceptable |
| −120° | 0/5 | 0/5 | 0/5 | 0/5 | Acceptable |
| −105° | 0/5 | 2/5 | 0/5 | 3/5 | Not acceptable |
| −90° | 0/5 | 5/5 | 0/5 | 5/5 | Not acceptable |

A: The frequency of rubbed states of toner images at the inlet of the rolling contact region.

B: The frequency of defects of toner images at the outlet of the rolling contact region.

As can be seen from Table 3, when the angle θ is greater than 105° and smaller than −105°, i.e., when the angle θ is in a range from 105° to 255° as measured only counterclockwise, toner images were neither rubbed at the inlet of the rolling contact region and nor defective at the outlet of the rolling contact region, indicating a good toner image fixing process. However, when the angle θ is equal or smaller than 105°, toner images were either rubbed at the inlet of the rolling contact region and or defective at the outlet of the rolling contact region, indicating a poor toner image fixing process.

As described above in detail, in the above embodiment, the heating roller 28 is positioned substantially upwardly of the fixing roller 22, i.e., the heating roller 28 is angularly positioned with respect to the fixing roller 22 such that the angle formed between the line segment L interconnecting the center of the heating roller 28 and the center of the fixing roller 22 and the reference line B interconnecting the center of the fixing roller 22 and the center of the pressing roller 24 lies in a range from about 105° to about 255°. Therefore, the fixing belt 32 that is trained around the fixing roller 22 and the heating roller 28 is so spaced from the supporting member 30 that the unfixed toner sheet fed on the supporting member 30 will not be brought into contact with the fixing belt 32. Stated otherwise, the fixing belt 32 is disposed in a position outside of a region where the unfixed toner sheet fed on the supporting member 30 possibly passes.

Consequently, no matter how the unfixed toner sheet being fed is curled due to jumping or sagging on account of the speed difference between a speed difference between the fixing apparatus 10' and a preceding toner image transferring apparatus, the unfixed toner image on the upper surface of the unfixed toner sheet is reliably prevented from touching the fixing belt 32, and can be led, without being disturbed, into the rolling contact region between the fixing roller 22 and the pressing roller 24, so that the toner image can reliably be fixed to the sheet by the fixing roller 22.

In the above mentioned embodiment, the fixing roller 22 comprises a resilient roller, and the pressing roller 24 comprises a roller harder than the fixing roller 22. Therefore, the fixing roller 22 can provide an upwardly concave surface in the nipping region, unlike the conventional structure. The upwardly concave nipping region provided by the fixing roller 22 produces forces tending to separate a sheet carrying a fixed toner image from the fixing belt 32. Even though the toner is carried on the surface of the sheet held in contact with the fixing belt 32, because the sheet can easily be separated from the fixing belt 32 due to the upwardly concave nipping region, the amount of oil applied to the fixing belt 32 by the oil applying roller 36 for preventing sheet offsets and jams may be relatively small. Actually, the upwardly concave nipping region provided by the fixing roller 22 is effective to avoid sheet offsets and jams between the fixing roller 22 and the pressing roller 24 even without the application of oil to the fixing belt 32 by the oil applying roller 36.

Furthermore, the fixing belt 32 is made of a material having a small heat capacity, trained around the heating roller 28 at a large contact angle, and held in intimate contact with the heating roller 28. As a result, even when sheets are passed at a high speed, i.e., even when a large number of sheets are passed in a unit time, through the nipping region, the temperature necessary to fix toner images to the sheets can reliably be maintained in the rolling contact region between the fixing roller 22 and the pressing roller 24.

In the embodiment, the resilient fixing roller 22 does not house any heater, but the heating roller 28 spaced from the fixing roller 22 houses the heater 26 therein. Thus, it is possible to sufficiently increase the thickness of the roller sleeve 28B that is made of a heat-resistant resilient material. Consequently, the nipping width in the rolling contract region can be sufficiently large while at the same time the fixing roller 22 may be relatively small in diameter.

In addition, the one-way clutch 98 disposed between the first driven gear 96 and the fixing roller 22 allows the pressing roller 24, rather than the fixing roller 22, as a primary drive roller for establishing a speed at which the unfixed toner sheet is fed through the nipping region. Therefore, even when the fixing roller 22 is heated in the fixing process and thermally expanded to increase its diameter, since the speed at which the unfixed toner sheet is fed through the nipping region is not established by the fixing roller 22, it is not varied by the thermal expansion of the fixing roller 22, but is maintained at a constant level. Consequently, the fixing belt 32 is maintained at a constant linear velocity to prevent toner images from being displaced or rubbed.

{Description of modifications in the other embodiment}

In the above embodiment, the unfixed toner sheet is introduced laterally into the fixing apparatus 10'. However, the unfixed toner sheet may be introduced vertically, e.g., upwardly, into the fixing apparatus 10'. In such a modification, the pressing roller 24 is disposed laterally of the fixing roller 22, and the heating roller 28 is disposed on one side of the fixing roller 22 which is opposite to the pressing roller 24.

In the above embodiment, the third thermistor 118 is provided to detect the temperature of the outer circumferential surface of the pressing roller 24.

Figure 15A:
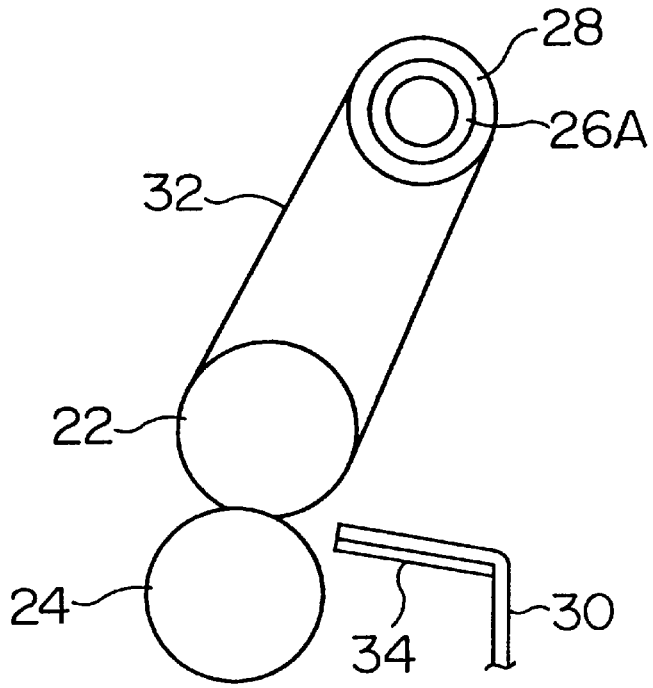
FIG. 15A is a front view of the first heat generating means according to a first modification of the present invention.

Furthermore in the embodiment, the heat generating source 26 has been described as being constructed from the halogen lamp which is installed in the heating roller 28. However, the principles of the present invention are not limited to such a construction, but the heat generating source may constructed from a plate-like heater 26A which is closely attached to the inner circumferential surface of the heating roller 28, as a first modification of the other embodiment shown in FIG. 15A.

Figure 15B:
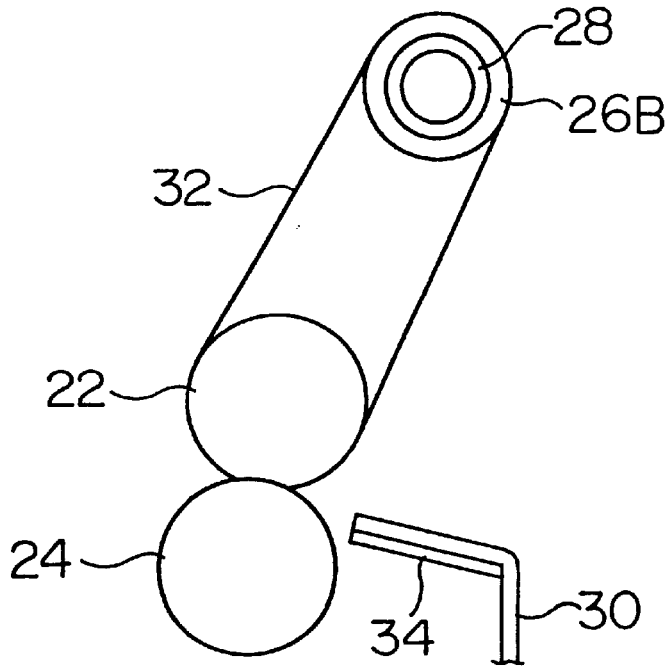
FIG. 15B is a front view of the first heat generating means according to a second modification of the present invention.

The heat generating source 26 is not limited to such a construction so that it is installed in the heating roller 28, but it may be constructed from a plate-like heater 26B which is located out of the heating roller 28, for example, closely attached to the outer circumferential surface of the heating roller 28, as a second modification of the other embodiment shown in FIG. 15B.

Figure 15C:
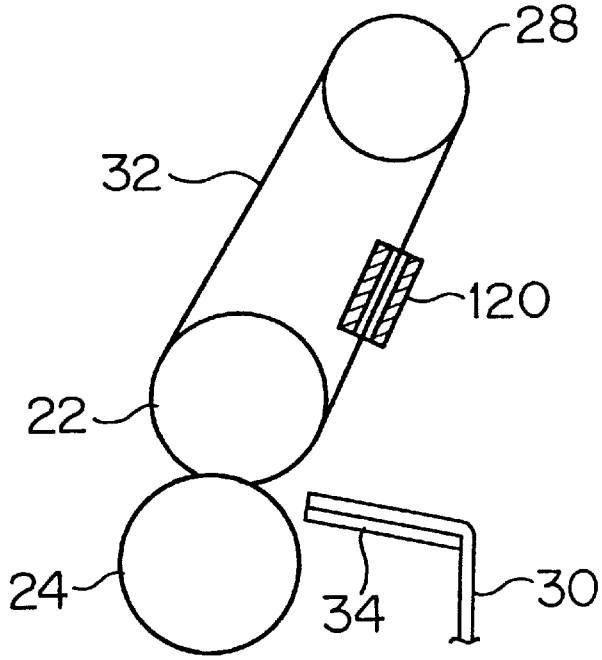
FIG. 15C is a front view of the first heat generating means according to a third modification of the present invention.
Figure 15D:
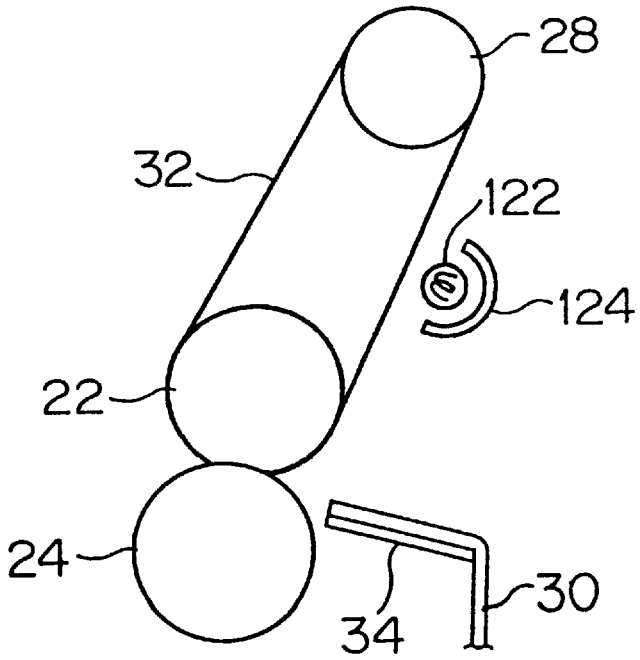
FIG. 15D is a front view of the first heat generating means according to a fourth modification of the present invention.
Figure 15E:
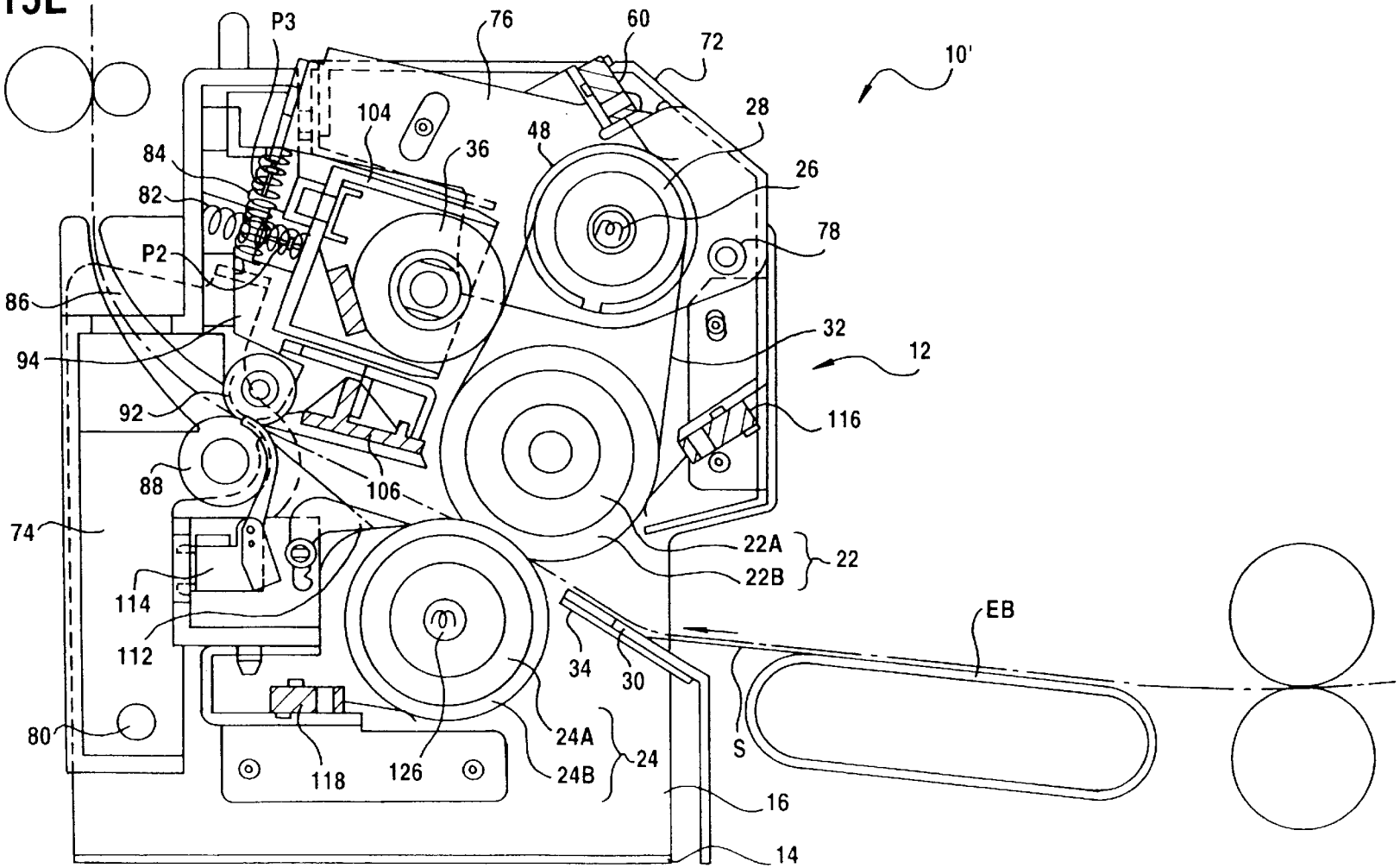
FIG. 15E is a front view of the first heat generating means according to a fifth modification of the present invention.
Figure 16:
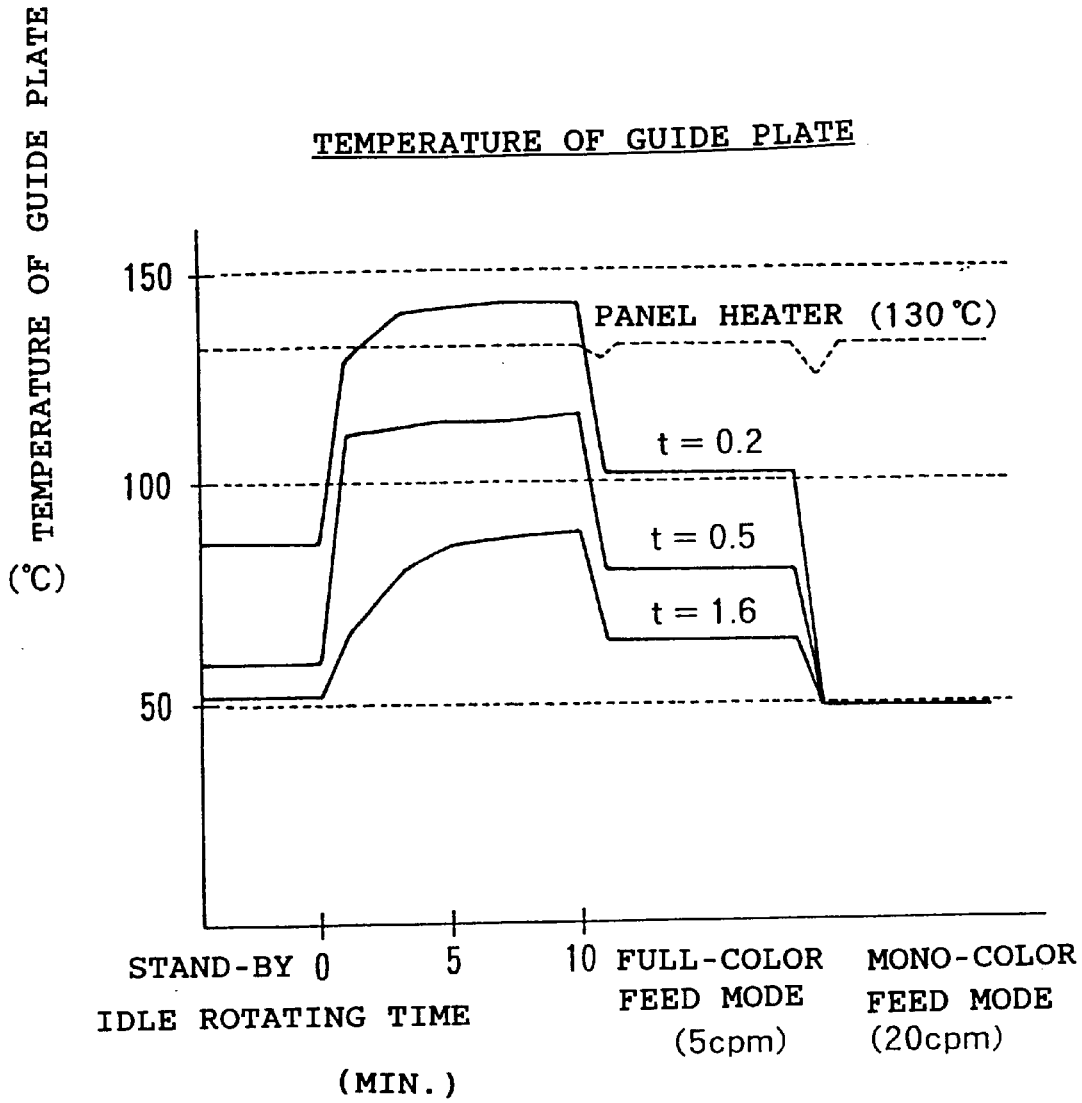
FIG. 16 is a diagram showing a relationship between the drive condition of a conventional fixing apparatus and the temperature of the guide plate.
Figure 17:
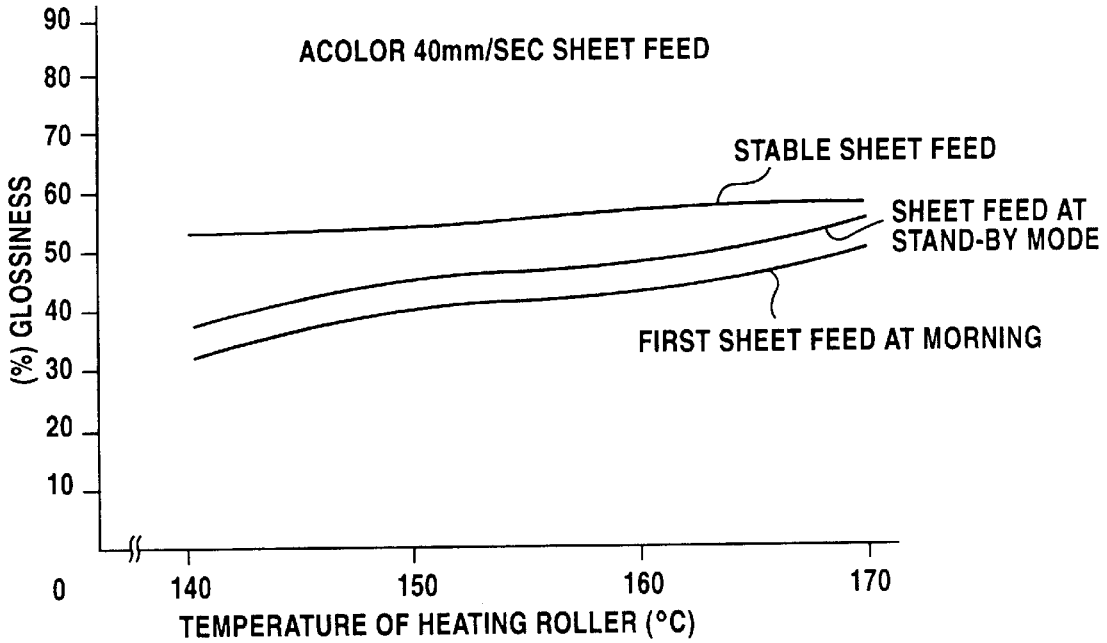
FIG. 17 is a graph showing a change of the glossiness of the sheet where the sheet feeding speed is set to be 40 mm/sec and the temperature of the heating roller is changed, in a case just after a warm up operation in the morning first is finished, a case just after a warm up operation from a stand-by mode is finished, and a case of stably feeding of the sheet, in a conventional fixing apparatus.
Figure 17:
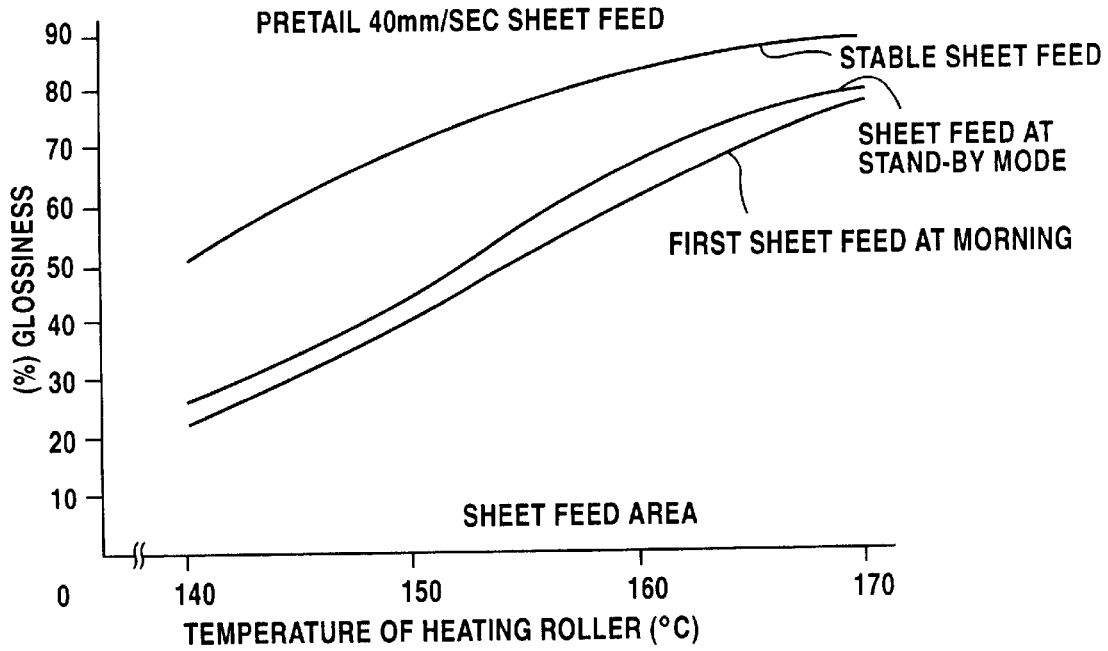
Figure 18:
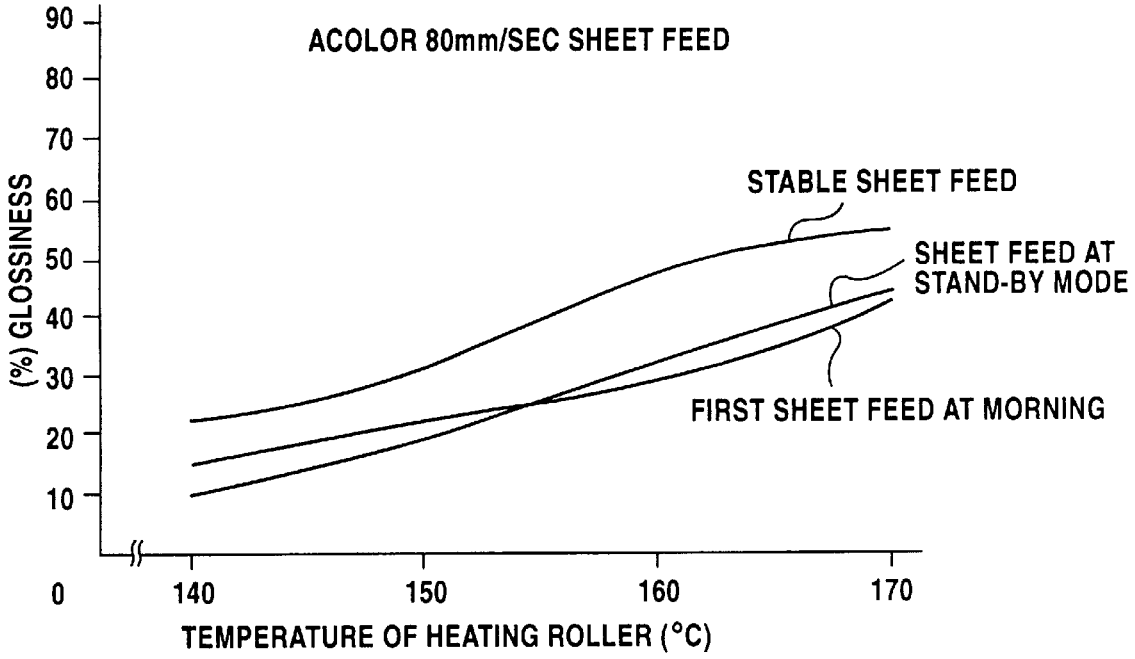
FIG. 18 is a graph showing a change of the glossiness of the sheet where the sheet feeding speed is set to be 80 mm/sec and the temperature of the heating roller is changed, in a case just after a warm up operation in the morning first is finished, a case just after a warm up operation from a stand-by mode is finished, and a case of stably feeding of the sheet, in a conventional fixing apparatus.
Figure 18:
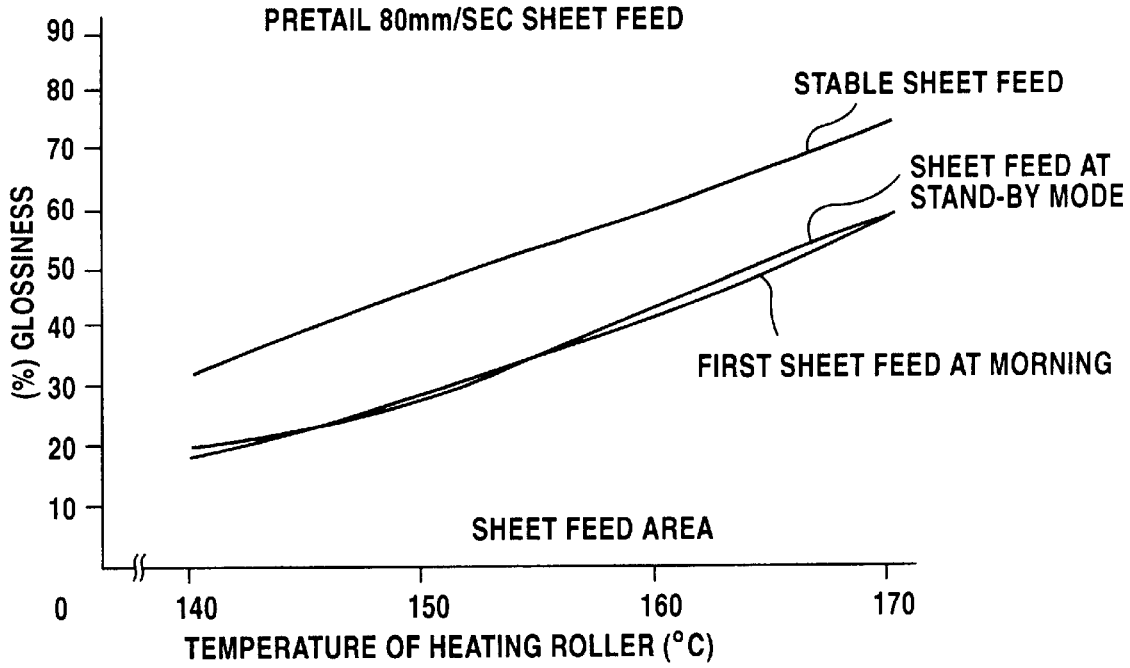
Figure 19:
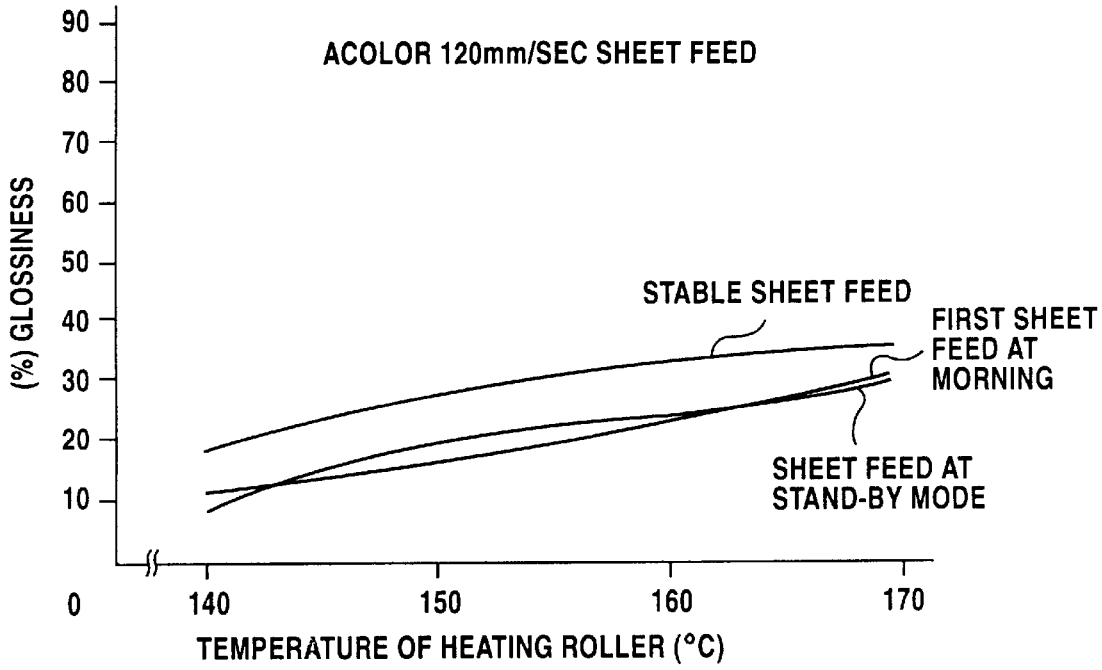
FIG. 19 is a graph showing a change of the glossiness of the sheet where the sheet feeding speed is set to be 120 mm/sec and the temperature of the heating roller is changed, in a case just after a warm up operation in the morning first is finished, a case just after a warm up operation from a stand-by mode is finished, and a case of stably feeding of the sheet, in a conventional fixing apparatus.
Figure 19:
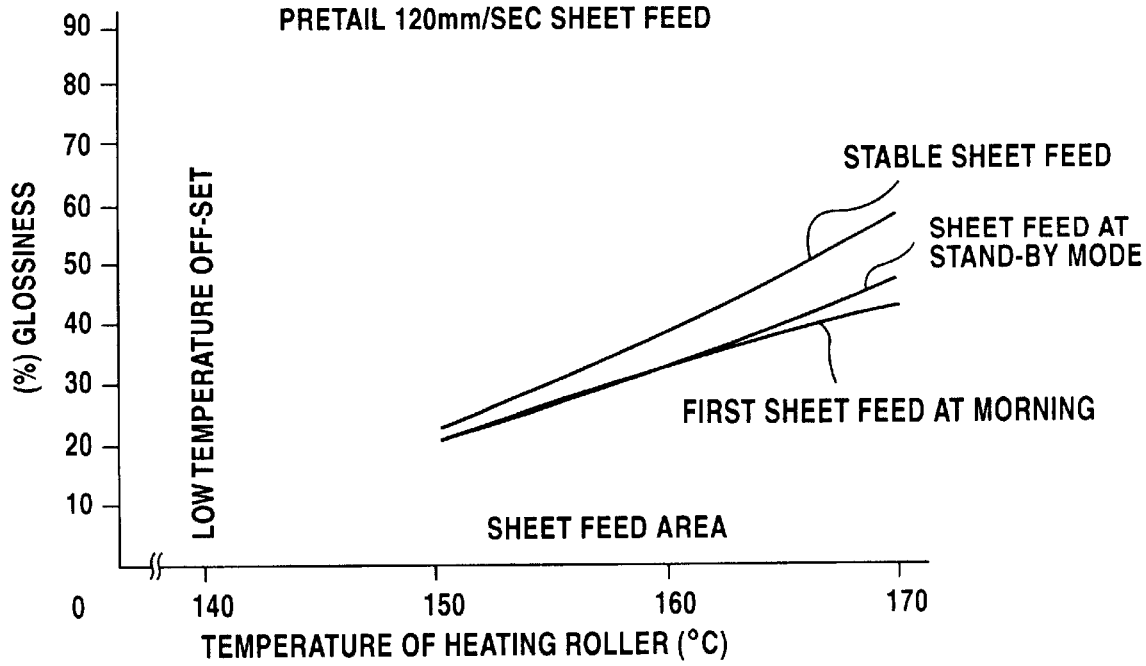

In the construction of which the heat generating source 26 is arranged out of the heating roller 28, it may be constructed from an induction heating mechanism 120 for directly heating the fixing belt 32 by an induction heating, as a third modification of the other embodiment shown in FIG. 15C or a mechanism including a halogen lamp 122 opposed to the outer circumferential surface of the fixing belt 32, for directly heating it and a reflector for reflecting the heat from the halogen lamp 122 to the fixing belt 32, as a fourth modification of the other embodiment shown in FIG. 15D.

In the third and fourth modifications shown in FIGS. 15C and 15D, respectively, the location of the induction heating mechanism 120 and the halogen lamp 122 is set to be between the fixing roller 22 and heating roller 28 and arranged in such a manner that they heat a portion of the fixing belt 32 which is positioned on the upstream side of the nipping portion with respect to the traveling direction of the fixing belt 32.

It should be noted that the fixing belt 32 must include the endless belt base of electroformed nickel, not of the synthetic resin such as a polyimide, in the third modification shown in FIG. 15C.

In the afore-mentioned other embodiment, the heat generating source 26 has been described as being arranged at a single location. However, the principles of the present invention are not limited to such a construction, but an additional heat generating source 126 may be installed in the pressing roller 24. In this case, it is necessary to provide the third thermistor 118 for detecting the temperature of the outer circumferential surface of the heating roller 24, being differed from the other embodiment.

Industrial Applicability

As described in detail above, the present invention can provide a fixing apparatus which is capable of ensuring the increase of the feeding speed of the recording medium, by effectively accomplishing to preheat the recording medium. Also, the present invention can provide a fixing apparatus which is capable of enhancing the preheat effect by preheating uniformly the recording medium. Further, the present invention can provide a fixing apparatus which is capable of maintaining the good quality of the toner image even though the feeding speed of the recording medium is increased. Thus, the fixing apparatus according to the present invention is suitable to be installed in the image forming apparatus such as an electrical copying machine, electrical printing machine, electrical facsimile machine, etc.

What is claimed is:

1. A fixing apparatus, comprising:

a fixing roller, and a pressing roller being rollingly contacted the fixing roller by a predetermined pressure, wherein an unfixed toner image which is carried on a sheet is fixed thereon by passing the sheet, on which the toner image is carried, through a nip portion between the fixing roller and the pressing roller along one direction, and further comprises:

a first heat generating means provided so as to be remote from said fixing roller, a heating roller provided so as to be remote from said fixing roller, a fixing belt endlessly trained around said heating roller and said fixing roller, for heating said sheet passing through said nip portion upon receiving the heat from said first heat generating means, a supporting member fixed on an upstream side of said pressing roller with respect to said one direction, for supporting the undersurface of said sheet prior to passing through said nip portion, and second heat generating means for heating said supporting member to preheat said sheet prior to pass through said nip portion.

2. The fixing apparatus according to the claim 1, wherein said supporting member includes one end neighboring said nip portion and the other end so as to be remote from said nip portion, and said the other end of the supporting member is set to be lower than said one end thereof.

3. The fixing apparatus according to the claim 2, wherein said supporting member is formed so as to be substantially flat.

4. The fixing apparatus according to the claim 1, wherein said supporting member is electrically grounded.

5. The fixing apparatus according to the claim 1, wherein said first heat generating means is housed in said heating roller.

6. The fixing apparatus according to the claim 5, wherein said first heat generating means includes a halogen lamp.

7. The fixing apparatus according to the claim 5, wherein said first heat generating means include a plate-like heat generating member attached to an inner peripheral surface of said heating roller.

8. The fixing apparatus according to the claim 1, wherein said first heat generating means is arranged so as to be out of said heating roller and opposing said fixing belt.

9. The fixing apparatus according to the claim 8, wherein said first heat generating means includes a plate-like heat generating member attached to an outer peripheral surface of said heating roller.

10. The fixing apparatus according to the claim 8, wherein said first heat generating means includes an induction heating means for heating said fixing belt by induction heating.

11. The fixing apparatus according to the claim 10, wherein said induction heating means is provided between said fixing roller and said heating roller, and heating that portion of said fixing belt which is positioned upstream side of said nip portion with respect to running direction of said fixing belt.

12. The fixing apparatus according to the claim 11, wherein said fixing belt includes an endless belt and a separating layer coated on an outer circumferential surface of an endless belt base.

13. The fixing apparatus according to the claim 12, wherein said endless belt base is made of metal belt.

14. The fixing apparatus according to the claim 13, wherein said endless belt base is made of electro-formed nickel.

15. The fixing apparatus according to the claim 8, wherein said first heat generating means includes a halogen lamp opposing said fixing belt.

16. The fixing apparatus according to the claim 1, wherein said second heat generating means is constructed so as to heat said supporting member substantially over the surface thereof.

17. The fixing apparatus according to the claim 1, wherein said second heat generating means is housed in said supporting member.

18. The fixing apparatus according to the claim 1, wherein said second heat generating means is arranged so as to closely contact with the surface of said supporting member.

19. The fixing apparatus according to the claim 18, wherein said second heat generating means is attached to the under surface of said supporting member.

20. The fixing apparatus according to the claim 18, wherein said second heat generating means is attached to the upper surface of said supporting member.

21. The fixing apparatus according to the claim 20, wherein said second heat generating means is coated by a separating layer on its upper surface.

22. The fixing apparatus according to the claim 21, wherein said separating layer has an electro-conductivity.

23. The fixing apparatus according to the claim 1, wherein said second heat generating means is arranged below and remote from said supporting member.

24. The fixing apparatus according to the claim 1, wherein said second heat generating means is formed of a material which is capable of maintaining a predetermined shape, and said supporting member is constructed by said second heat generating means.

25. The fixing apparatus according to the claim 24, wherein said second heat generating means is coated by a separating layer on its upper surface.

26. The fixing apparatus according to the claim 25, wherein said separating layer has an electro-conductivity.

27. The fixing apparatus according to the claim 1, wherein said heating roller is arranged in a preheat effecting area in which the heat radiated from said fixing belt can preheat said sheet prior to pass through said nip portion.

28. The fixing apparatus according to the claim 1, wherein said heating roller is arranged out of a preheat effecting area in which the heat radiated from said fixing belt can preheat said sheet prior to pass through said nip portion.

29. The fixing apparatus according to the claim 1, wherein said fixing belt includes an endless belt and a separating layer coated on an outer circumferential surface of an endless belt base.

30. The fixing apparatus according to the claim 29, wherein said endless belt base is made of metal belt.

31. The fixing apparatus according to the claim 30, wherein said endless belt base is made of electro-formed nickel.

32. The fixing apparatus according to the claim 29, wherein said endless belt base is made of synthetic resin.

33. The fixing apparatus according to the claim 32, wherein said synthetic resin has an electro-conductivity.

34. The fixing apparatus according to the claim 32, wherein said endless belt base is made of polyimide.

35. The fixing apparatus according to the claim 34, wherein said polyimide has an electro-conductivity.

* * * * *